US010561880B2

(12) United States Patent
Pollock

(10) Patent No.: US 10,561,880 B2
(45) **Date of Patent: *Feb. 18, 2020**

(54) STRETCHING APPARATUS AND METHOD OF USE

(71) Applicant: Michael Pollock, Bryn Mawr, PA (US)

(72) Inventor: Michael Pollock, Bryn Mawr, PA (US)

( * ) Notice: Subject to any disclaimer, the term of this patent is extended or adjusted under 35 U.S.C. 154(b) by 88 days.

This patent is subject to a terminal disclaimer.

(21) Appl. No.: 15/985,286

(22) Filed: May 21, 2018

(65) Prior Publication Data

US 2018/0264304 A1 Sep. 20, 2018

Related U.S. Application Data

(63) Continuation-in-part of application No. 15/180,062, filed on Jun. 12, 2016, now Pat. No. 9,974,993.

(60) Provisional application No. 62/174,217, filed on Jun. 11, 2015.

(51) Int. Cl.

| | |
|---|---|
| ***A63B 21/002*** | (2006.01) |
| ***A63B 21/00*** | (2006.01) |
| ***A63B 21/055*** | (2006.01) |
| ***A63B 23/035*** | (2006.01) |
| *A63B 23/00* | (2006.01) |
| *A63B 21/02* | (2006.01) |
| *A63B 71/06* | (2006.01) |

(52) U.S. Cl.

CPC .... *A63B 21/0023* (2013.01); *A63B 21/00185* (2013.01); *A63B 21/0555* (2013.01); *A63B 21/0557* (2013.01); *A63B 21/4033* (2015.10); *A63B 21/4034* (2015.10); *A63B 21/4035* (2015.10); *A63B 21/4043* (2015.10); *A63B 23/035* (2013.01); *A63B 23/03508* (2013.01); *A63B 21/025* (2013.01); *A63B 2023/006* (2013.01); *A63B 2071/0602* (2013.01); *A63B 2071/0694* (2013.01)

(58) Field of Classification Search

None

See application file for complete search history.

(56) References Cited

U.S. PATENT DOCUMENTS 4,174,832 A * 11/1979 Thompson ..... A63B 21/018 482/120

4,261,562 A * 4/1981 Flavell ..... A63B 21/0053 482/6

(Continued)

*Primary Examiner* — Stephen R Crow

(74) *Attorney, Agent, or Firm* — Joseph E. Maenner; Maenner & Associates, LLC

(57) ABSTRACT

An exercise and flexibility assessing apparatus includes a handle having a flexible member opening and a latch opening formed therein. A shaft support is mounted in the handle. The shaft support has a first wall and a second wall, distal from the first wall. A spool is rotatably mounted between the first wall and the second wall. A flexible member with indicia for assessment has a first end fixedly connected to the spool and a second end extending outwardly from the handle through the flexible member opening. A latch mechanism has an activating portion that extends outwardly of the spool toward the latch opening and a latching portion pivotally engaging the first wall. The latching portion is movable between a first position wherein the spool is rotatable with respect to the handle and a second position wherein the spool is fixed with respect to the handle.

28 Claims, 39 Drawing Sheets

(56) References Cited

U.S. PATENT DOCUMENTS 4,501,230 A * 2/1985 Talo ..... A01K 27/004 119/796
5,122,106 A * 6/1992 Atwood ..... A61H 1/0244 482/131
5,269,512 A * 12/1993 Crowson ..... A63B 21/153 473/229
5,876,310 A * 3/1999 Mackey ..... A63B 21/153 482/114
6,210,348 B1 * 4/2001 Reed ..... A61H 1/0292 482/72
6,634,995 B1 * 10/2003 Reed ..... A63B 21/153 482/132
6,685,602 B2 * 2/2004 Colosky, Jr. ..... A63B 21/025 482/122
7,250,021 B2 * 7/2007 Leight ..... A63B 21/025 482/116
7,637,853 B2 * 12/2009 Crowson ..... A63B 21/00 482/127
7,753,827 B1 * 7/2010 Emick ..... A63B 21/00181 482/44
8,998,779 B1 * 4/2015 Ihli ..... A63B 21/00185 482/115
9,358,413 B2 * 6/2016 Verdi ..... A63B 71/023
9,687,689 B2 * 6/2017 Lin ..... A63B 21/018
2002/0160891 A1 * 10/2002 Gallagher ..... A63B 21/04 482/123
2006/0030464 A1 * 2/2006 Udwin ..... A63B 21/00043 482/126
2006/0201450 A1 * 9/2006 Jordan ..... A01K 27/004 119/796
2010/0016132 A1 * 1/2010 Flynn ..... A63B 21/0004 482/122
2013/0196833 A1 * 8/2013 Strickland ..... A63B 21/025 482/131
2013/0197398 A1 * 8/2013 Strickland ..... A61B 5/11 600/595
2015/0148199 A1 * 5/2015 Strickland ..... A61H 1/0218 482/91

* cited by examiner

STRETCHING APPARATUS AND METHOD OF USE

CROSS-REFERENCE TO RELATED APPLICATION

The present application is a continuation-in-part of U.S. patent application Ser. No. 15/180,062, filed on Jun. 12, 2016 (allowed), which claims priority from U.S. Provisional Patent Application Ser. No. 62/174,217, filed on Jun. 11, 2015, both of which are incorporated herein by reference in their entireties.

BACKGROUND OF THE INVENTION

Field of the Invention

The present invention relates to a stretching apparatus for physical therapy.

Background

A large percentage of the population suffers from back and upper leg muscle distress. Exercise devices have been developed to help stretch and loosen such distressed muscles. Some of those devices, while helping to stretch and loosen the muscles, fail to provide an indication to the user of any advances made as a result of using the device. It would be beneficial to provide a stretching device that allows the user to see how well he/she is stretching, and to also see improvements after repeated use of the device.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is an exercise apparatus that includes a handle having a flexible member opening and a latch opening formed therein. A shaft support is mounted in the handle. The shaft support has a first wall and a second wall, distal from the first wall. A spool is rotatably mounted between the first wall and the second wall. A flexible member has a first end fixedly connected to the spool and a second end extending outwardly from the handle through the flexible member opening. A latch mechanism has an activating portion that extends outwardly of the spool toward the latch opening and a latching portion pivotally engaging the first wall. The latching portion is movable between a first position wherein the spool is rotatable with respect to the handle and a second position wherein the spool is fixed with respect to the handle.

In another embodiment, the present invention is an exercise apparatus comprising a hollow handle, a shaft support fixedly mounted in the handle, and a spool rotatably mounted on the shaft support. A flexible strap has a first end secured to the spool and a second end extending outwardly from the handle. A latching mechanism has a first position wherein the spool is rotatable with respect to the handle and a second position wherein the spool is fixed with respect to the handle, the latching mechanism pivotally mounted on the shaft support.

In still another embodiment, the present invention is an exercise apparatus comprising a handle having a strap through-opening and a latch through-opening formed therein, a shaft support fixedly mounted inside the handle, and a shaft mounted on the shaft support. A spool is mounted on the shaft. The shaft has at least one cam face extending around a periphery thereof. A strap has a first end wrapped around the spool and a second end extending outwardly from the handle through the strap through-opening. A latching mechanism has a first portion extending outwardly from the spool toward the latch through-opening. The latching mechanism has a tab adapted to releasably engage one of the cam faces. A first biasing member is attached to the latching mechanism and is adapted to bias the tab against the at least one cam face. A second biasing member has a first end attached to the shaft and a second fixed end. The second biasing member is adapted to wind the strap around the spool when the latching mechanism is disengaged from the at least one of the cam face.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
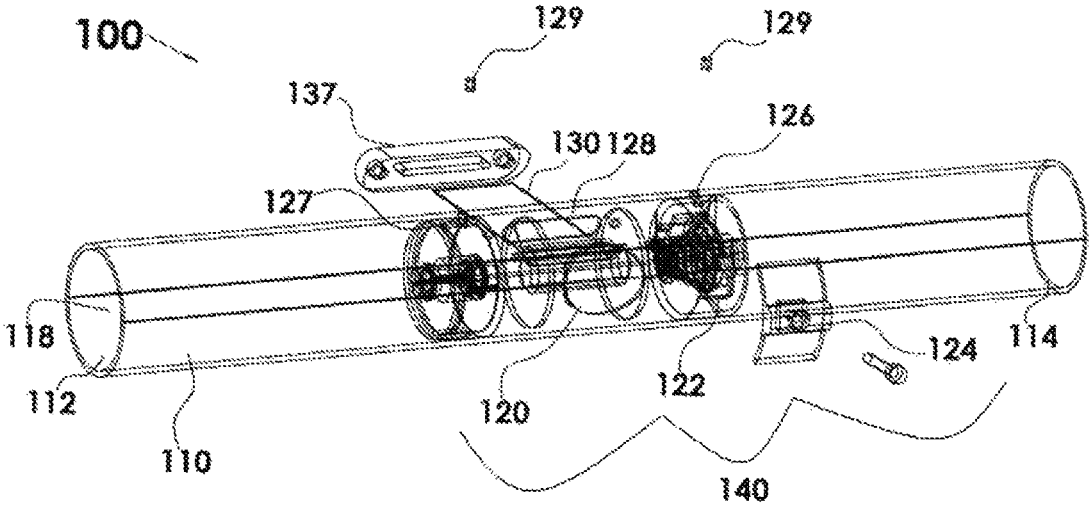
FIG. 1 shows a perspective, partially exploded view of a physical therapy device/stretching apparatus according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "inner" means a direction toward an axially central portion of the inventive device and the term "outer" means a direction away from the axially central portion of the inventive device. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Although the subject matter described herein may be described in the context of illustrative implementations to process one or more computing application features/operations for a computing application having user-interactive components the subject matter is not limited to these particular embodiments. Rather, the techniques described herein can be applied to any suitable type of user-interactive component execution management methods, systems, platforms, and/or apparatus.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Referring to the Figures, a stretching apparatus 100 according to an exemplary embodiment of the present invention is shown. Stretching apparatus 100 can be used for physical therapy exercises including stretching of the hamstring muscles, hips, knees, and other locations and to improve flexibility in a user. The hamstring stretch can aid in treating of many ailments.

Referring specifically to FIG. 1, stretching device or apparatus 100 includes a handle 110, a user link 130, and a link retracting mechanism 140. Handle 110 can be a hollow tube having a first end 112, a second end 114, and a hollow through-space 116 extending therebetween. Handle 110 could be other geometries and may or may not be hollow. A longitudinal axis 118 extends through handle 110 between first and 112 and second end 114. User link 130 is generally located in a center portion of handle 110.

Handle 110 includes a sight opening 120, generally central located between first and 112 and second end 114. Handle 110 allows for generally balanced forces in a user's left and right hands and arms during the use of device 100; this is beneficial to keep a user's body aligned properly during the use of device 100, particularly during stretching of the hamstrings. Sight opening 120 can be used to view indicia printed on user link 130 to determine how far user link 130 has been extended from handle 110. The indicia can be an indication of the user's flexibility and improvement through use of device 100. Although handle 110 is illustrated as a unitary element in the current embodiment, those skilled in the art will recognize that handle 110 and the functionality of handle 110 can be provided through multiple components and different shapes.

Additionally, a release opening 122 is formed in handle 110 between sight opening 120 and second end 114, to allow a release initiator 124 to lock and unlock retracting mechanism 140 from exterior of handle 110 via a mechanical connection between release initiator 124 and retracting mechanism 140. Those skilled in the art will recognize that opening 120 could be located elsewhere on handle 110 to provide allowance for locking and unlocking retracting mechanism 140.

Further, through openings 126, 127 can be formed in handle 110 to provide through openings for screws 129 that can be used to secure retracting mechanism 140 to handle 110. Alternatively, those skilled in the art will recognize that retracting mechanism 140 can be secured to handle 110 by other means, such as, for example, by crimping. Additionally, an elongate guide opening 128 is generally diametrically opposed from sight opening 120. Guide opening 128 is long enough to allow a user link 130 to extend therethrough so that user link 130 can be extended from (by unwinding from spool 142) and retracted into handle 110. While handle 110 is shown as a generally cylindrical tube, those skilled in the art will recognize that handle 110 can also be formed with exterior contours, such as, for example handholds, or other structures, not shown.

Figure 2:
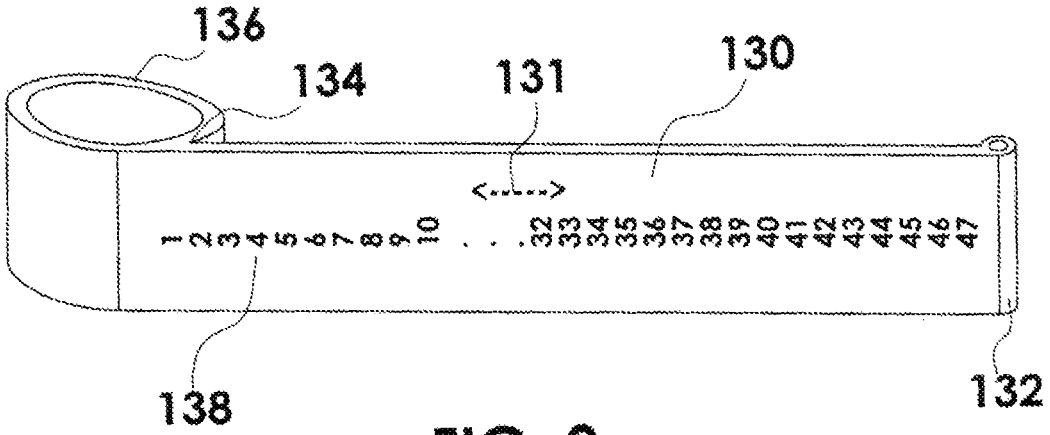
FIG. 2 shows a perspective view of a user link used with the stretching apparatus shown in FIG. 1.
Figure 5C:
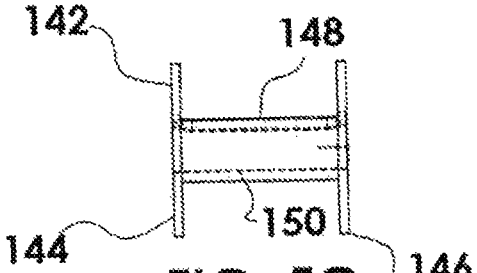
FIG. 5C shows a side elevational view of the spool shown in FIG. 5A.
Figure 5B:
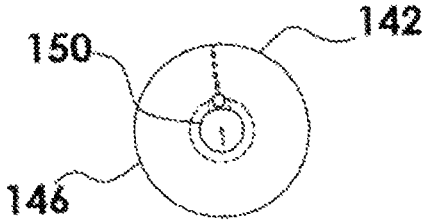
FIG. 5B shows an end view of the spool shown in FIG. 5A.
Figure 5A:
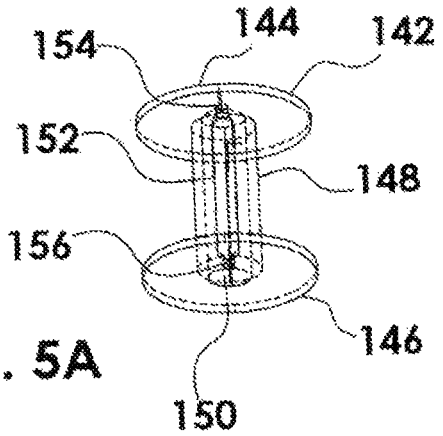
FIG. 5A shows a perspective view of a spool used in the retracting mechanism shown in FIG. 3.
Figure 5D:
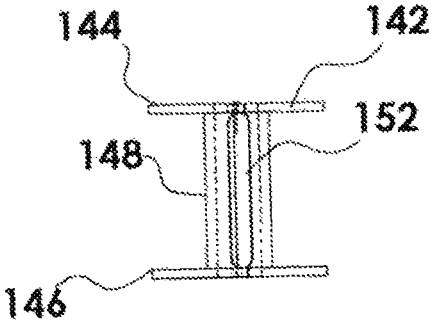
FIG. 5D shows a top plan view of the spool shown in FIG. 5A.

Referring now to FIG. 2, user link 130 is an elongate, generally flat fabric material inextensible in an axial, or tensile direction, shown by arrow 131. In an exemplary embodiment, user link 130 can be nylon, although those skilled in the art will recognize that other material that is inextensible in an axial or tensile direction can be used. The material from which user link 130 is constructed has sufficient flexural rigidity properties that provide the capability of winding user link 130 around retracting mechanism 140, as well as positioning around a user's extremity, such as, for example, the user's foot. Those skilled in the art will recognize that the user can be barefoot or wearing footwear when inserting the foot into user link 130. In an exemplary embodiment, user link 130 has a thickness of between about 0.01" and about 0.05", although those skilled in the art will recognize that user link 130 can have other thicknesses.

User link 130 has a first, or fixed end 132 is that is secured to and wraps around retracting mechanism 140. Fixed end 132 includes a loop 133 that is used to secure user link 130 to link retracting mechanism 140. User link 130 has a second, or free end 134, distal from fixed and 132 that includes a loop 136 that is sized to allow the user to insert extremity, such as, the user's foot, into loop 136 in order to extend user link 130 from handle 110. While user link 130 is shown with loop 136 for direct attachment to the user's extremity, those skilled in the art will recognize that free end 134 of user link 130 can be coupled to an intermediate device (not shown) that is attached to the user's extremity.

User link 130 can include indicia 138 printed thereon between fixed end 132 and free end 134 that is visible through sight opening 120 in handle 110 so that the user can see how far user link 130 has been extended from handle 110. While numbers are shown in FIG. 2 as indicia 138, those skilled in the art will recognize that other types of indicia, such as, for example, letters, symbols, audible, etc., can be used instead of numbers. Those skilled in the art will also recognize other types of measurement means, such as an encoder or rotation counter, for example could be used instead of lineal measurement.

Figure 3:
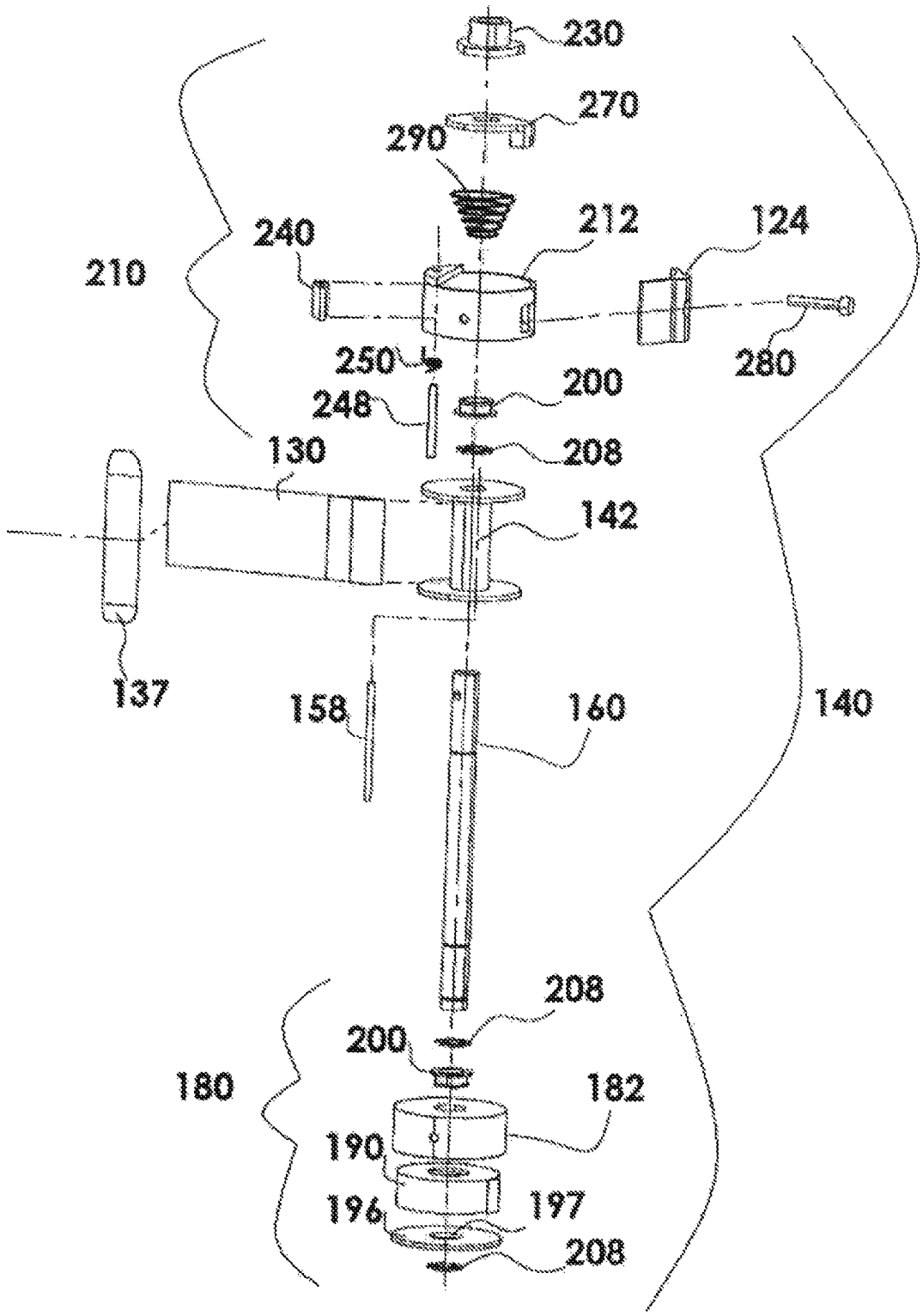
FIG. 3 shows an exploded view of a retracting mechanism used with the stretching apparatus shown in FIG. 1.
Figure 4D:
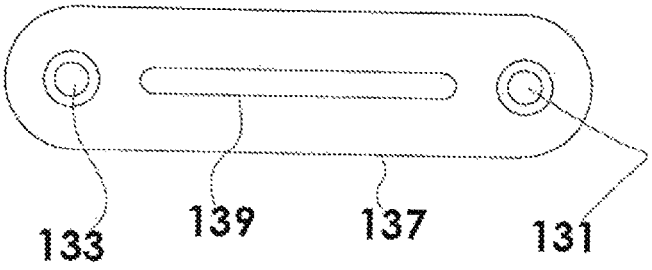
FIG. 4D shows a top plan view of the guide shown FIG. 4A.
Figure 4B:
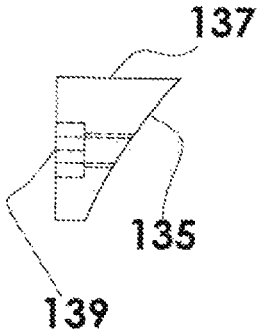
FIG. 4B shows an end view of the guide shown FIG. 4A.
Figure 4C:
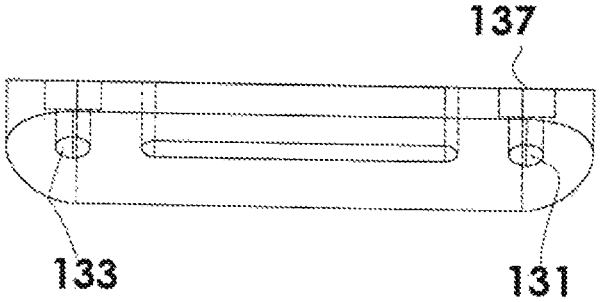
FIG. 4C shows a side elevational view of the guide shown in FIG. 4A.
Figure 4A:
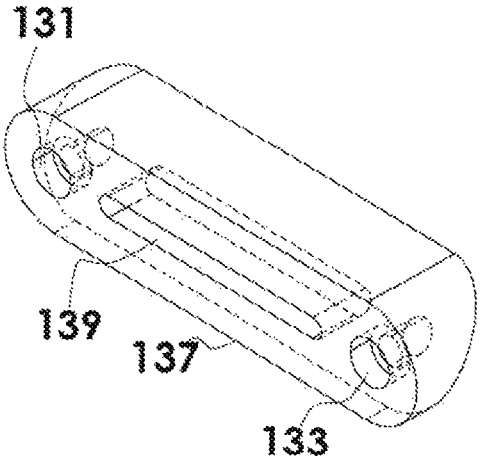
FIG. 4A shows a perspective view of a user link guide used with the stretching apparatus shown FIG. 1.

Referred FIGS. 1, 3 and 4A-4E, a guide 137 is coupled to handle 110 such that guide 137 extends over guide opening 128. Guide 137 is used to guide user link 130 as user link 130 is extended from or retracted into handle 110. Guide 137 includes an elongate slot 139 extending therethrough. Slot 139 is sufficiently long and wide to allow user link 130 to extend therethrough without binding and to reduce friction between user link 130 and handle 110. As seen in FIG. 4B, guide 137 includes a concave engagement face 135 that is contoured to snugly engage the surface of handle 110. Through-openings 131, 133 on either side of slot 139 are spaced to align with through-openings in handle 110, in order to allow securing means, such as, for example, screws (not shown) to extend through through-openings 131, 133, and into through-openings to secure guide 137 to handle 110. Alternatively, other securing means, such as, for example, glue, can be used to secure guide 137 to handle 110. Still alternatively, guide 137 can be an insert (not shown) that is press fit into slot 139.

Figure 4E:
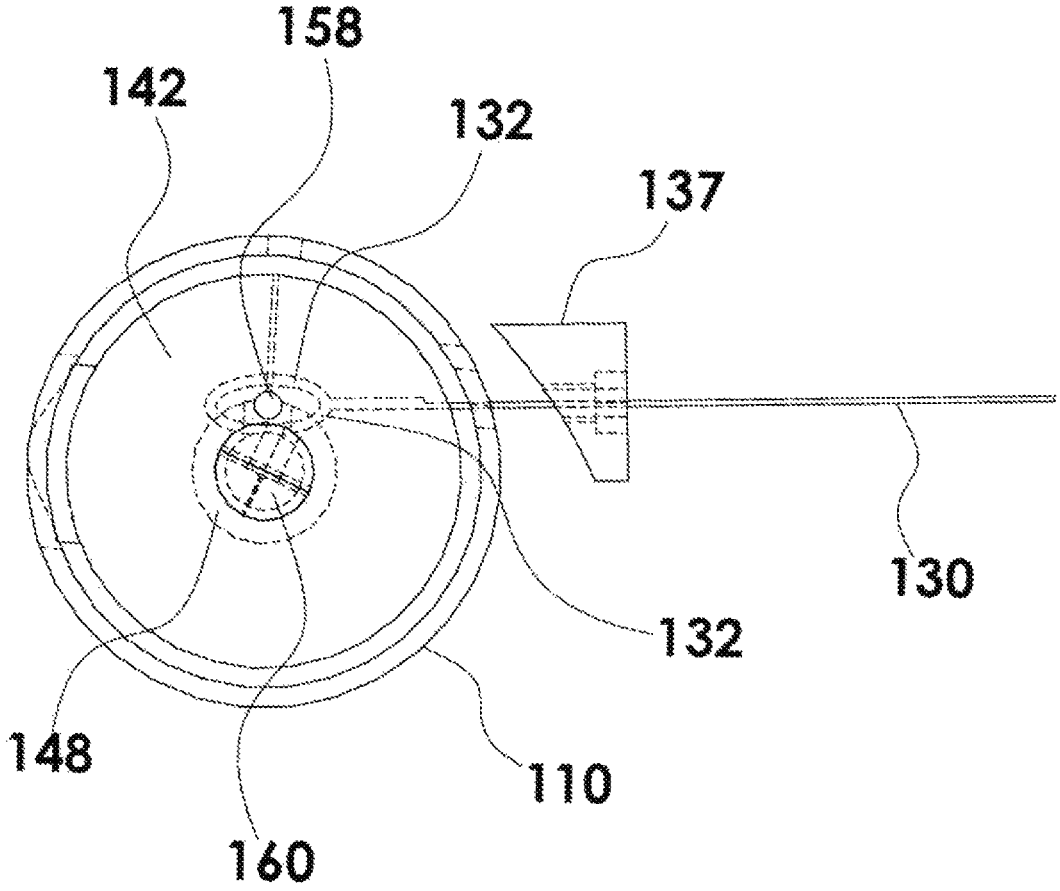
FIG. 4E shows a sectional view of the stretching apparatus taken through the center of the device.
Figure 6C:
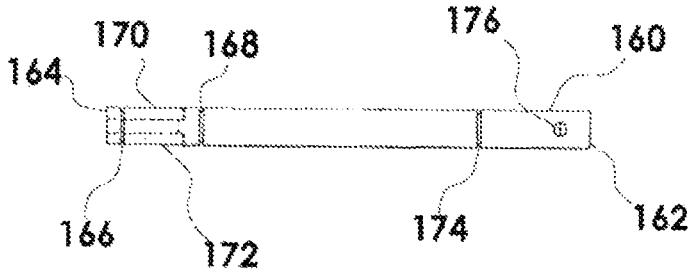
FIG. 6C shows a side elevational view of the shaft shown in FIG. 6A.
Figure 6A:
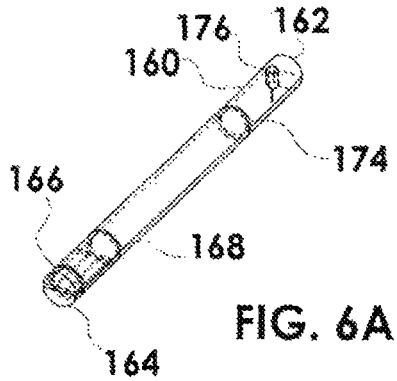
FIG. 6A shows a perspective view of a shaft used in the retracting mechanism shown in FIG. 3.
Figure 6D:
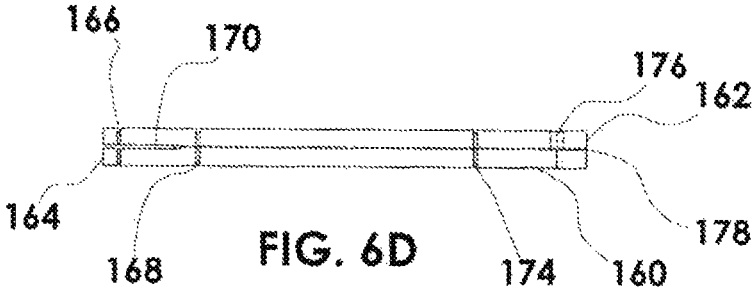
FIG. 6D shows a top plan view of the shaft shown in FIG. 6A.
Figure 6B:
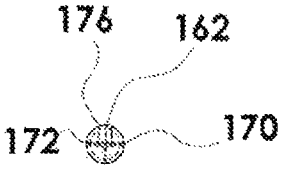
FIG. 6B shows an end of the shaft shown in FIG. 6A.
Figure 7B:
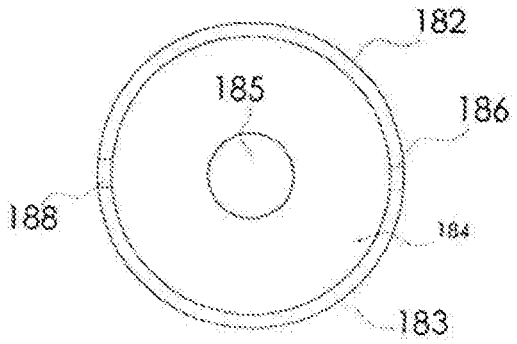
FIG. 7B shows an end view of the spring housing and shaft support shown in FIG. 7A.
Figure 7A:
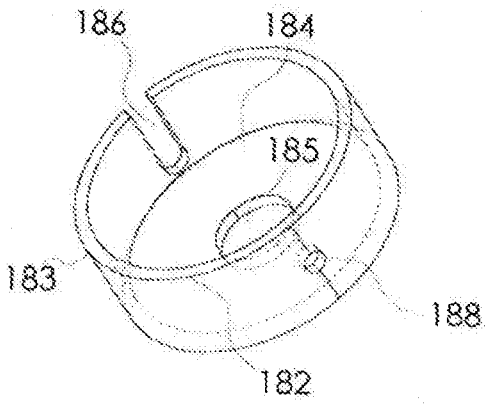
FIG. 7A shows a perspective view of a spring housing used in the retracting mechanism shown in FIG. 3.
Figure 7C:
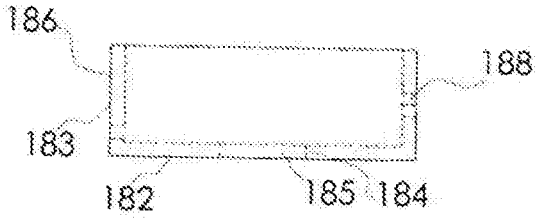
FIG. 7C shows a side elevational view of the spring housing shown in FIG. 7A.
Figure 7D:
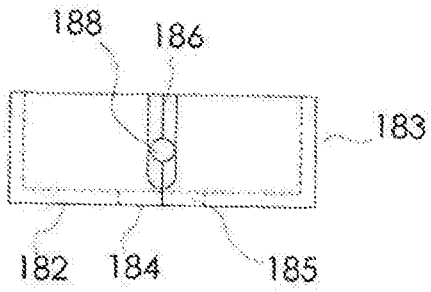
FIG. 7D shows a top plan view of the spring housing shown in FIG. 7A.

As shown in FIG. 4E, guide 137 is positioned such that user link 130 extends from handle 110 at an angle that is generally tangent to user link 130 when about one half of user link 130 is wrapped around a rotor, such as a spool 142. This angle is desired in order to align user link 130 with the user and to facilitate a smooth extension and retraction of user link 137 with respect to handle 110. Guide 137 also reduces or eliminates the contact of user link 130 with handle 110 and reduces friction and noise as user link 130 is extended from or retracted into handle 110.

Referring in general to FIGS. 3-17D, retracting mechanism 140 and its components are shown. FIG. 3 shows an exploded view of the components of retracting mechanism 140. A central component to retracting mechanism 140 is a spool 142, shown in more detail in FIGS. 4E and 5A-5D.

Spool 142 includes a first annular end 144 and a second annular end 146, with a generally tubular body 148 extending therebetween. Body 148 is sufficiently wide between first annular end 144 and second annular end 146 to allow user link 130 to be rolled up on body 148, between ends 144, 146, with sufficient space to prevent user link 130 from binding on spool 142. Spool 142 is aligned with slot 139 in guide 137 so that slot 139 aligns user link 130 with body 148 of spool 142 when winding or unwinding user link 130 onto or from spool 142. Body 148 includes a through-opening 150 extending to and through first annular end 144 and second annular end 146. Through-opening 150 is sized to allow the passage of a shaft 160 (shown in FIG. 3 and FIGS. 6A-6D) to extend therethrough. Spool 142 can be fixedly connected to shaft 160, such as, for example, by welding, a mechanical connection, such as, for example, a screw, or other fixed connection means known to those skilled in the art. While spool 142 and shaft 160 are shown as two separate elements, those skilled in the art will recognize that school 142 and shaft 160 can be formed as a single, unitary element. In an exemplary embodiment, the width of body 148 can be between about ⅛" and about 3".

Body 148 also includes an opening, or slot 152 extending between first annular end 144 and second annular end 146. Slot 152 allows a user link 130 to be inserted therethrough. First end 144 includes a through-hole 154 extending therethrough and second end 146 includes a through-hole 156 extending therethrough. Through-holes 154, 156 are axially aligned with each other and with slot 152 to allow a rigid pin 158 (shown in FIG. 3) to be inserted therethrough. Pin 158 extends through first end 132 of user link 130 and engages first end 144 and second end 146 of spool 142 to secure user link 130 to spool 142 in order to render user link 130 unable to be removed from spool 142 after retracting mechanism 140 is assembled. Sufficient space is provided between each of through-holes 154, 156 and through-opening 150 to allow for the thickness of user link 130 and pin 158. Axial motion of pin 158 is limited once pin 158 is installed such that pin 158 cannot slide out of retracting mechanism 140 during operation.

Referring to FIG. 3 and FIGS. 6A-6D, shaft 160 extends through through-opening 150 in spool body 148 and provides for axial support and rotation of spool 142 with shaft 160. Shaft 160 is a generally solid cylinder having a first end 162 and a second end 164, located distal from first end 162. Shaft 160 includes a first peripheral groove 166 located proximate to second end 164 and a second peripheral groove 168 is spaced a distance from first peripheral groove 166. The spacing between first peripheral groove 166 and second peripheral groove 168 is sized to allow a support housing 182 (shown in FIG. 3) to fit snugly therebetween. Those skilled in the art will recognize that peripheral grooves 166, 168 can be located at various locations along shaft 160.

A diametric slot 170 extends from second end 164 toward second peripheral groove 168. Slot 170 is used to accept an engagement portion 192 of a rewind spring 190 (shown in FIG. 8).

Additionally, shaft 160 includes a third peripheral groove 174 spaced from first end 162 proximately the same distance that second peripheral groove 168 is spaced from second end 164. Third peripheral groove 174 is spaced sufficiently far from first peripheral groove 168 such that spool 142 readily fits between third peripheral groove 174 and first peripheral groove 168. Those skilled in the art will recognize that grooves or other means of axial stops can be placed along the length of shaft 160.

A hole 176 is formed between third peripheral groove 174 and first end 162. Hole 176 extends radially from the exterior of shaft 160 toward a shaft axis 178, which, when shaft 160 is assembled into handle one, 10, extends, coaxially with axis 118. Hole 176 is used to secure a cam 230 to shaft 160, such as, for example, with a set screw (not shown). Those skilled in the art, however, will recognize that cam 230 can be secured to shaft 160 by other means, such as, for example, by welding, keying, or other known securement method. Still alternatively, cam 230 can be a unitary structure with shaft 160. Still further, other forms of rotating parts, with protruding parts, such as sprockets, gears or other suitable mechanical devices may also be used to perform similar duties as cam 230.

Referring back to FIG. 3 and FIGS. 7A-9C, a spring assembly 180 is used to provide rotational energy to retract user link 132 into handle 110. Spring assembly is located on one side of handle 110 relative to spool 142. Spring assembly 180 includes support housing 182 into which rewind spring 190 is inserted.

Referring now to FIGS. 7A-7D, support housing 182 is a generally tubular structure having circular sidewall 183 with an outer diameter sized to fit snugly within the interior of handle 110, but with sufficient clearance to allow support housing 182 to be inserted axially into the interior of handle 110. Support housing 182 includes an inner end plate 184 at a first end thereof. Inner end plate 184 includes a through-opening 185 to allow shaft 160 to pass therethrough.

Sidewall 183 includes a slot 186 extending from a second end of sidewall 183 toward inner plate 184. Slot 186 is sized to retain an end 194 of rewind spring 190 (shown FIG. 8A). Sidewall 183 also includes opening 188 extending therethrough diametrically opposed from slot 186, although those skilled in the art will recognize that circular opening 188 does not necessarily need to be diametrically opposed from slot 186. When support housing 182, is inserted into handle 110, opening 188 aligns with through opening 127 in order to secure spring housing 182 to handle 110.

Figure 8B:
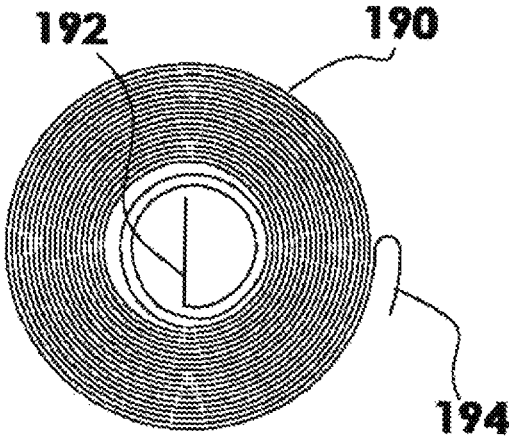
FIG. 8B shows an interview of the rewind spring shown in FIG. 8A.
Figure 8D:
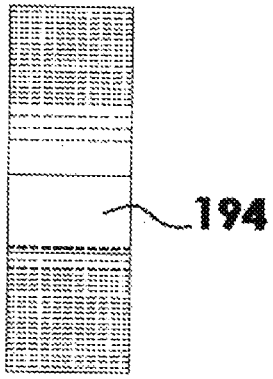
FIG. 8D shows a top plan view of the rewind spring shown in FIG. 8A.
Figure 8C:
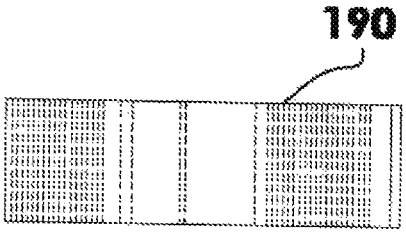
FIG. 8C shows a side elevational view of the rewind spring shown in FIG. 8A.
Figure 8A:
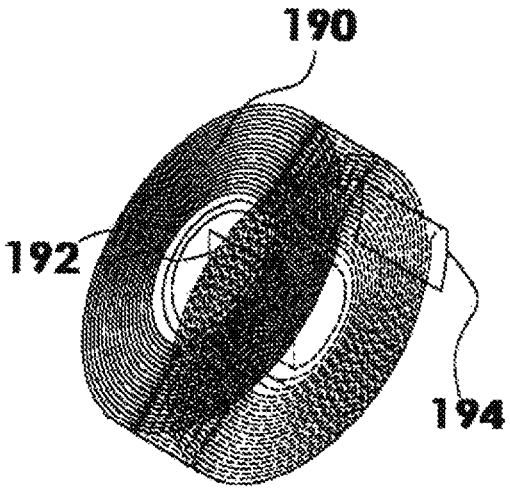
FIG. 8A shows a perspective view of a rewind spring used in the retracting mechanism shown in FIG. 3.

Referring now FIGS. 8A-8D, rewind spring 190 is a metallic stressed or prestressed ribbon spring that is coiled and is wound and unwound when shaft 160 rotates. Note that FIGS. 8A and 8B are not necessarily to scale with respect to the number of turns in spring 190. In an exemplary embodiment, spring 190 has a thickness of about 0.006 inches (about 0.18 mm). Spring 190 has an outer diameter sized to fit within support housing 182. Spring 190 includes an inner end 192 that extends axially and is inserted into slot 170 in shaft 160 in order to secure spring 190 to shaft 160. An outer end 194 of spring 190 is inserted through slot 186 in support housing 182 to secure spring 190 with respect to support housing 182.

Spring 190, with end 192 secured to slot 170 of shaft 160, and end 194 secured to opening 186 of shaft support 182, stores rotational energy when spring 190 is being wound (by turning of shaft 160). Spring 190 releases rotational energy as spring 190 is being unwound (by turning of shaft 160 in the opposite direction). In an exemplary embodiment, spring 190 can be rotated between about 0 and about 40 turns. In a further exemplary embodiment, spring 190 can be rotated about 18 turns while user link 130 is unwinding from retracting mechanism 140 outward from handle 110 (thereby turning shaft 160), which results in extension of user link 130 a distance of about 3½ feet from handle 110. The distance of about 3½ feet is a common distance used in exercise/rehabilitation equipment in physical therapy, particularly for hamstring stretching and lower back therapy. The rotational energy stored in spring 190 is transmitted through shaft 160 and spool 142 to rewind user link 130 into handle 110. Those skilled in the art will recognize that more or less than 3½ feet of exercise length can be provided; i.e.—the distance that user link 130 is able to unwind from retracting mechanism 140.

Referring back to FIG. 3, an outer end plate 196 is located against sidewall 183 of support housing 182 (shown in FIGS. 7A-7D) to secure spring 190 within support housing 182. Outer end plate 196 includes a central opening 197 that is sized to fit over shaft 160.

Figure 9A:
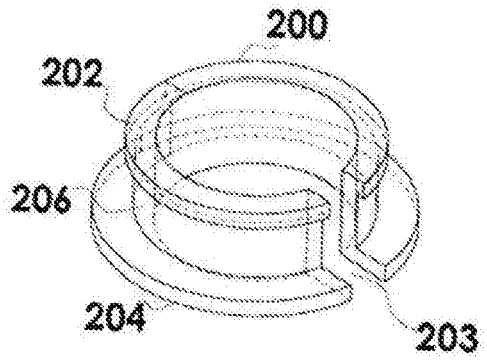
FIG. 9A shows a perspective view of a bushing used in the retracting mechanism shown in FIG. 3.
Figure 9B:
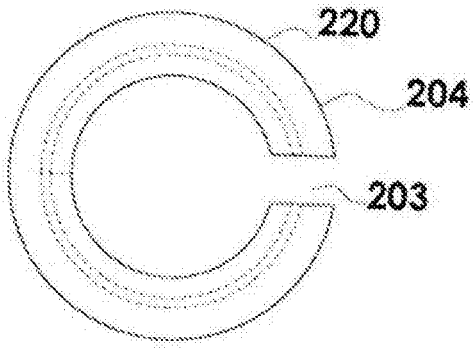
FIG. 9B shows an interview of the bushing shown in FIG. 9A.
Figure 9C:
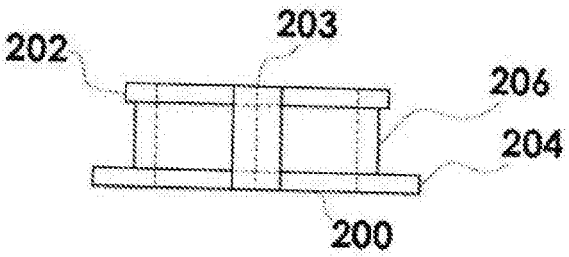
FIG. 9C shows a side elevational view of the bushing shown in FIG. 9A.
Figure 10B:
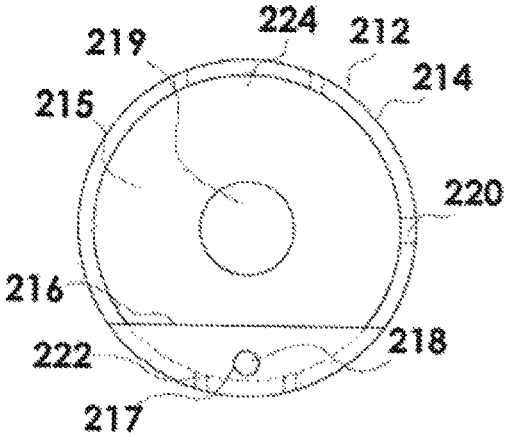
FIG. 10B shows an end view of the latching housing shown in FIG. 10A.
Figure 10A:
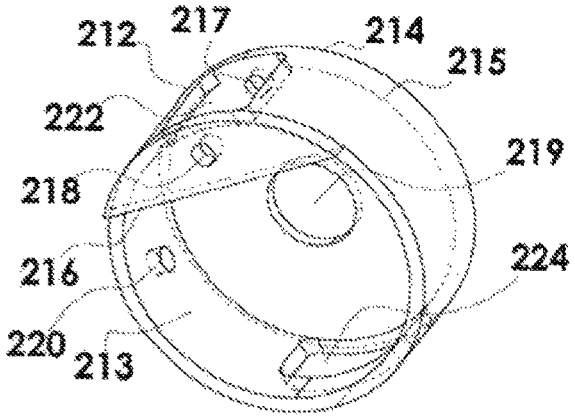
FIG. 10A shows a perspective view of a spring housing used in the latching mechanism shown in FIG. 3.
Figure 10C:
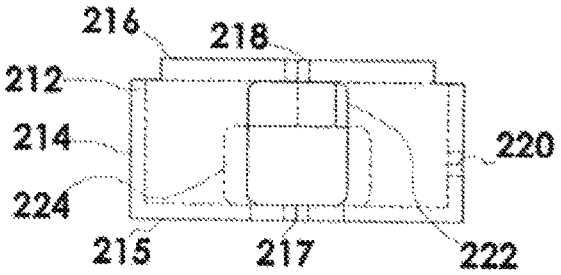
FIG. 10C shows a side elevational view of the latching housing shown in FIG. 10A.
Figure 10D:
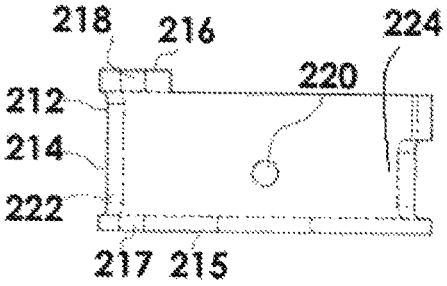
FIG. 10D shows a top plan view of the latching housing shown in FIG. 10A.
Figure 11B:
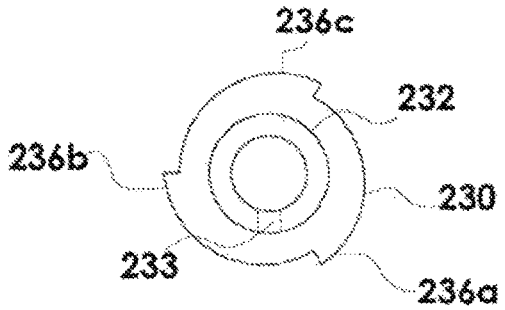
FIG. 11B shows an end view of the cam shown in FIG. 11A.
Figure 11A:
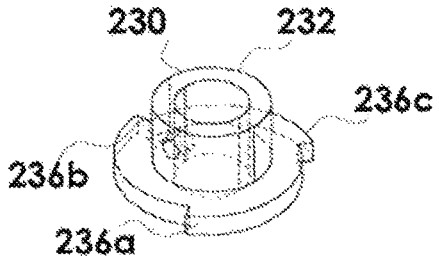
FIG. 11A shows a perspective view of a cam used in the latching mechanism shown in FIG. 3.
Figure 11C:
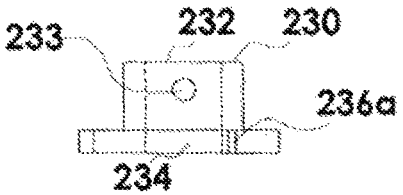
FIG. 11C shows a side elevational view of the cam shown in FIG. 11A.
Figure 11D:
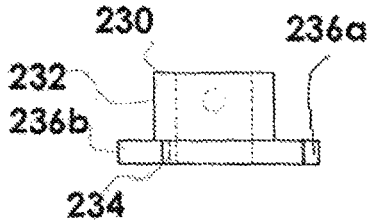
FIG. 11D shows a top plan view of the cam shown in FIG. 11A.
Figure 12B:
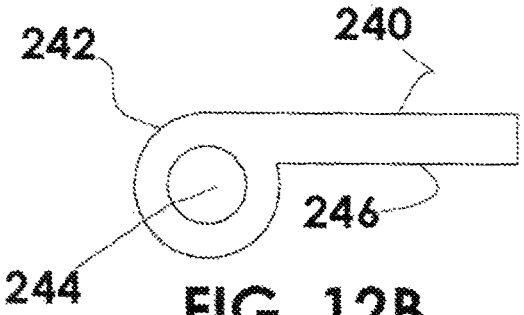
FIG. 12B shows an end view of the latch shown in FIG. 12A.
Figure 12A:
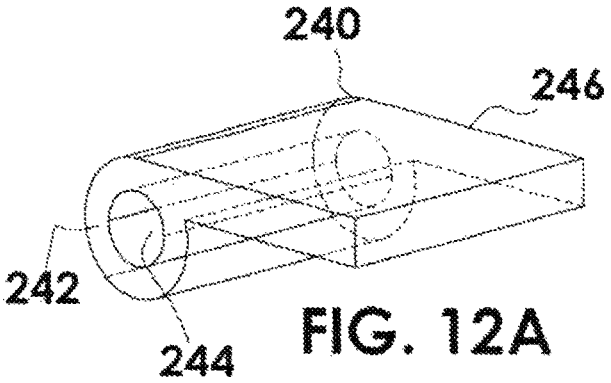
FIG. 12A shows a perspective view of a latch used in the latching mechanism shown in FIG. 3.
Figure 12D:
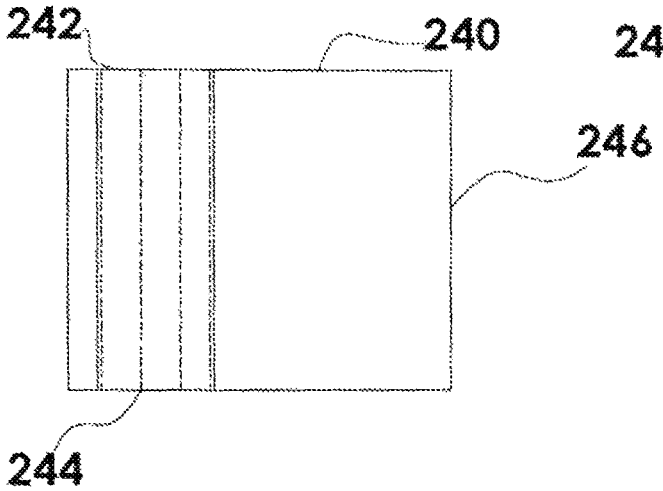
FIG. 12D shows a top plan view of the latch shown in FIG. 12A.
Figure 12C:
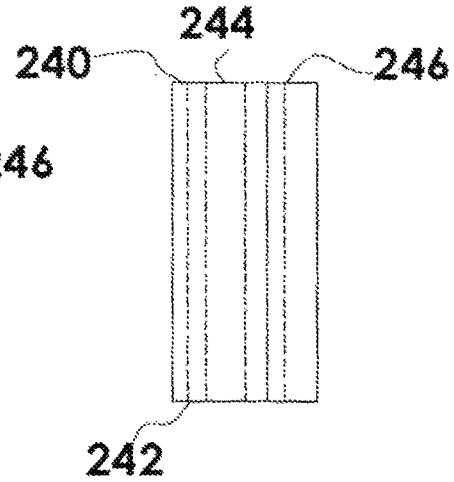
FIG. 12C shows a side elevational view of the latch shown in FIG. 12A.

Referring to FIGS. 9A-9C, a bushing 200 is used to support housing 182 on shaft 160. Bushing 200 includes an inner diameter sized to allow shaft 160 to be inserted therethrough. Optionally, bushing 200 can include an outer lip 202 that is slightly larger than through-opening 186 in inner end plate 184, such that outer lip 202 can snap through through-opening 186 and secure bushing 200 to support housing 182. Still optionally, bushing 200 can be a split bushing with a split 203 that allows outer lip 202 to snap through through-opening 186. Bushing 200 also includes an inner lip 204 having a larger diameter than outer lip 202, such that outer lip 202 rides along the interface of inner end plate 184. Bushing 200 further includes a body 206 extending between inner lip 204 and outer lip 202 that is sized to allow support housing 182 to be located between inner lip 204, an outer lip 202. Those skilled in the art will recognize that bushing 200 (or other means of bearing surface) can be integrally formed with support housing 182.

Referring back to FIG. 3, a retaining C-clip 208 is inserted into each of first peripheral groove 166 and second peripheral groove 168 of shaft 160, on either side of support housing 182 to retain support housing 182 in a desired location along shaft 160. Those skilled in the art, however, will recognize that other means may be provided instead of C-clip 208 (and grooves 166, 168, 174) to prevent axial motion of support housing 182.

Referring now to FIGS. 3 and 10A-17D, a latching mechanism 210 is located on a side of link retracting mechanism 140, opposite from spring assembly 180. Those skilled in the art, however, will recognize that spring assembly 180 does not necessarily need to be opposite from latching mechanism 210. Latching mechanism 210 includes a latching support housing 212, shown in FIGS. 10A-10D. Latching support housing 212 contains mechanism used to latch user link 130, rendering user link 130 unable to unwind further from spool 142 (to extend user link 130). Latching mechanism 210 also has means to release latch 240 to allow user link 130 to be extended from handle 110 as user desires. The default mode of retractor 210 is latching mode. Those skilled in the art will recognize that latching mechanism 210 can default to be normally latched, or to be normally unlatched in different embodiments of the design.

Latching support housing 212 is a generally tubular structure having circular sidewall 214 with an outer diameter sized to fit within the interior of handle 110. Latching support housing 212 includes an inner end plate 215 at a first end thereof. Inner end plate 215 includes a through-opening 216 to allow shaft 160 to pass therethrough. Inner plate 214 also includes a first latch pin opening 217.

Latching support housing 212 also includes an outer end plate 216 that extends only partially along latching support housing 212, leaving an opening 213 sized to allow for insertion of other elements of latching mechanism 210. Outer end plate 216 also includes a second latch pin opening 218 that is axially aligned with first latch pin opening 217 to support ends of a latch pin 248 (shown in FIG. 3). Supports 210 and 212 are shown as separate components in the illustrated embodiment. Those skilled in the art will recognize that supports 210 and 212, along with their functionality, can be provided in a unitary or coupled element.

Sidewall 214 also includes a hole 220 that is aligned with opening 126 in handle 110 to accept a securing element, such as, for example, a screw (not shown), to secure latching support housing 212 to handle 110. Additionally, sidewall 214 can include an opening 222 between inner end plate 215 and outer end plate 216 to accommodate a latch 240 (shown in FIGS. 3 and 12A-12D). Opening 224 is provided to accommodate a latch release mechanism 260 (also shown in FIG. 3). Those skilled in the art, however, will recognize that opening 224 is not necessarily needed to be diametrically opposed from opening 222. Optionally, latching support housing 212 can be supported on shaft 160 by an additional bushing 200, similar to bushing 200 used to support housing 182.

Housing 182 and latching support housing 212 are spaced sufficiently from each other to transmit the force transmitted by housing 182 and latching support housing 212 to handle 110.

Referring now to FIGS. 3 and 11A-11D, a cam 230 that is used in latching mechanism 210 is shown. Cam 230 includes a generally tubular body 232 having an inner diameter sized to allow insertion of shaft 160 therethrough. A through-opening 233 extends through tubular body 232. As discussed above, cam 230 is fixedly connected to shaft 160. A securing mechanism, such as, for example, a screw, is extended through through-opening 233, and into hole 176 in shaft 160. Alternatively, cam 230 can be a one-piece integral unit with shaft 160. An inner surface 234 of body 232 includes a plurality of cam lobes 236*a-c* extending outwardly from body 232.

Cam lobes 236*a-c* are used to releasably engage latch 240 in order to stop rotation of shaft 160 to prevent extension of user link 130 from handle 110. Latch 240 includes a generally cylindrical pivoting portion 242 having a generally circular through-opening 244 that is sized to accept latch pin 248 inserted therethrough. Latch 240 also includes a lever arm 246 that extends from pivoting portion 242. Lever arm 246 releasably engages with one of cam lobes 236*a-c* to restrict rotation of shaft 160 only in a direction that would allow extension of user link 130.

Latch pin 248 extends through first latch pin opening 217, opening 244 in latch 240, and second latch pin opening 218 in order to pivotally support latch 240 inside latching support housing 212.

Figure 13:
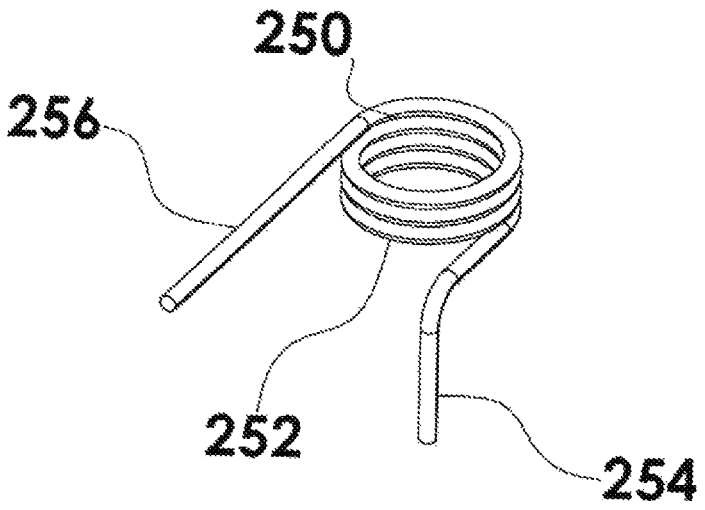
FIG. 13 shows a perspective view of a torsion spring use with the latch shown FIGS. 12A-12D.
Figure 14:
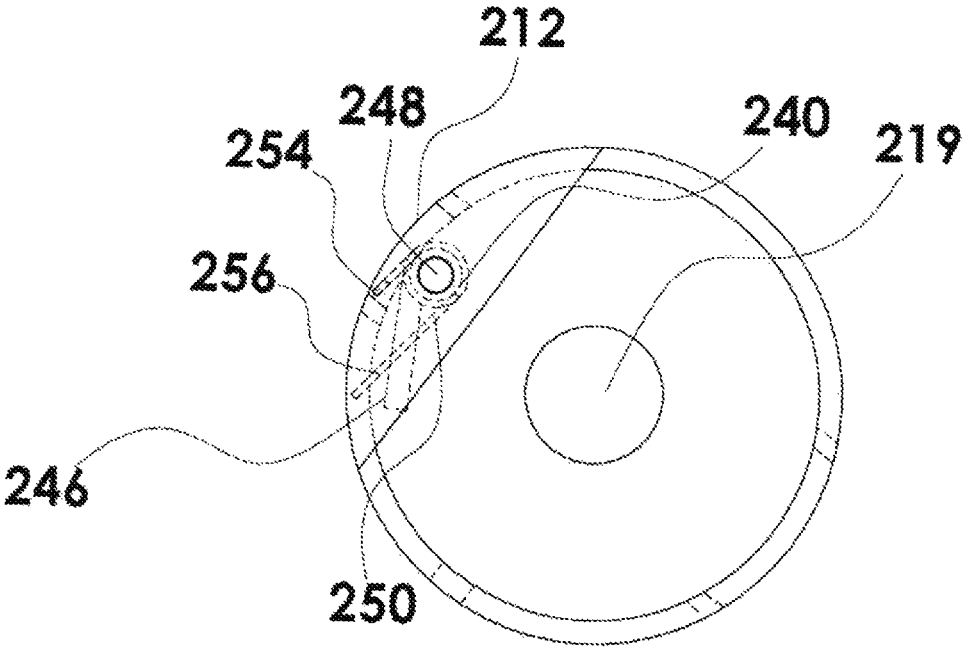
FIG. 14 is a side view showing the latch of FIGS. 12A-D inserted into the latching housing shown in FIGS. 10A-10D.

A torsion spring 250 is shown in FIG. 13. Torsion spring 250 includes a central coil 252 having an inner diameter sized to allow latch pin 248 to extend therethrough. Torsion spring 250 also includes a first, axially extending, end 254 and a second, lateral, end 256. Axially extending end 254 engages lever arm 246 and biases lever arm 246 in a radially inward direction, toward cam lobes 236*a-c*. Lateral end 256 engages latching support housing 212, as shown in FIG. 14. It is important to note that torsion spring 250 biases latch 240 to motion into cam path to engage cam 230, unless this action is overcome by latch release mechanism 260. Latch pin 248 does not necessarily need to pass through the interior of torsion spring 250.

Figure 15A:
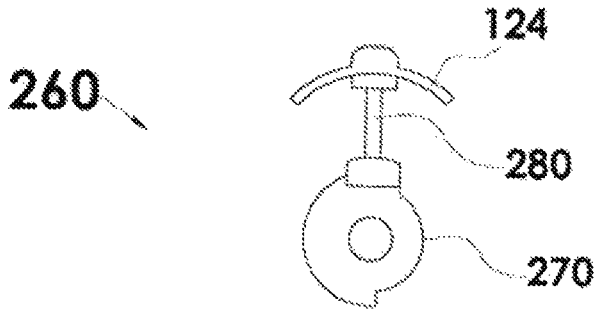
FIG. 15A is a side elevation view of a latch release mechanism inserted into latching housing shown in FIGS. 10A-10D.
Figure 15B:
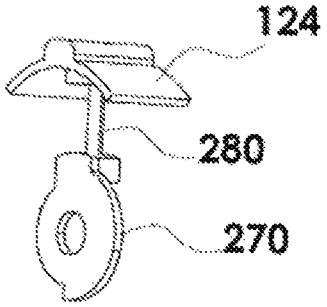
FIG. 15B is a left perspective view of the latching release mechanism of FIG. 15A.
Figure 15C:
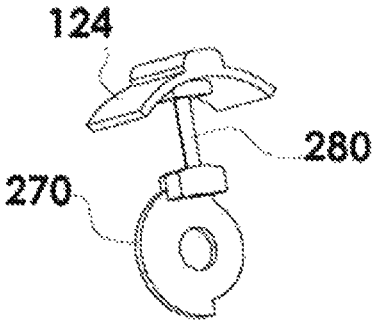
FIG. 15C is a right perspective view of the latching release mechanism of FIG. 15A.
Figure 16B:
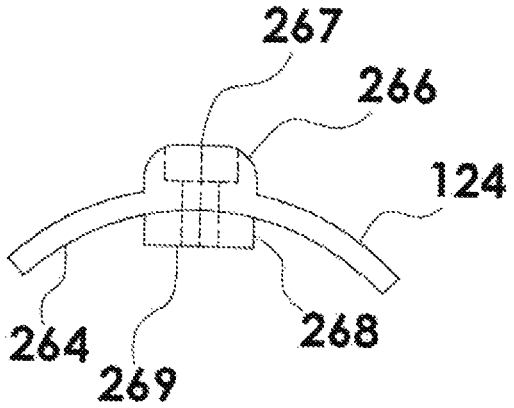
FIG. 16B is a side elevational view of the release initiator shown in FIG. 16A.
Figure 16A:
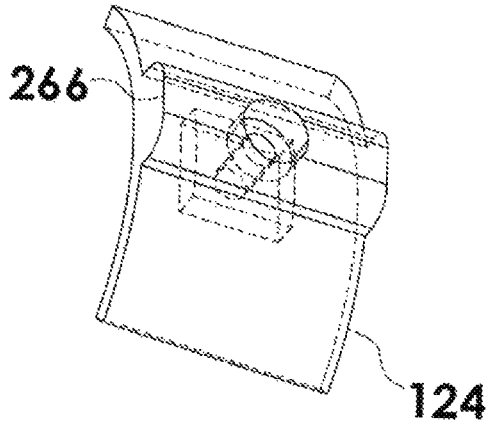
FIG. 16A is a perspective view of a release initiator used with the latching release mechanism of FIG. 15A.
Figure 16C:
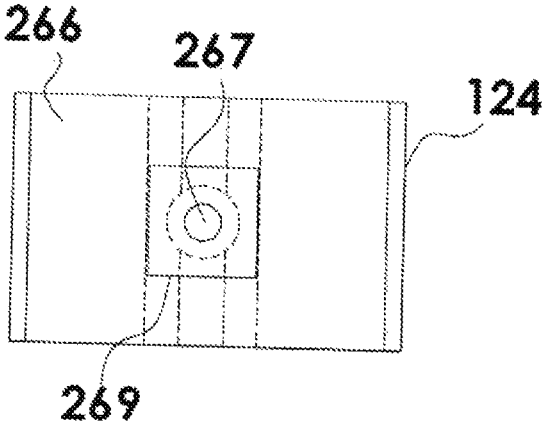
FIG. 16C is a top plan view of the release initiator shown in FIG. 16B, taken along lines 16C-16C of FIG. 16B.
Figure 16D:
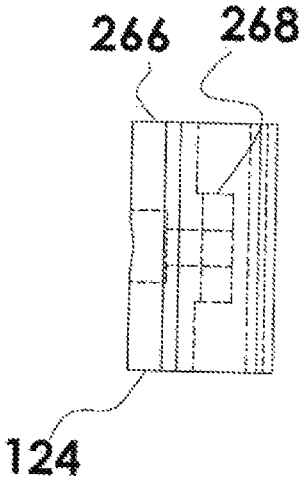
FIG. 16D is a side view of the release initiator shown in FIG. 16C, taken along lines 16D-16D of FIG. 16C.
Figure 17C:
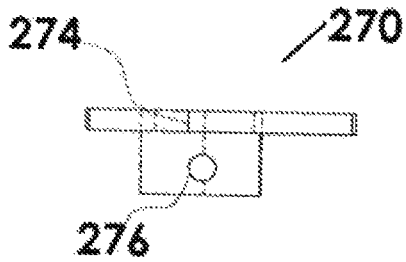
FIG. 17C is a top plan view of the release cam shown in FIG. 17B, taken along lines 17C-17C of FIG. 17B.
Figure 17A:
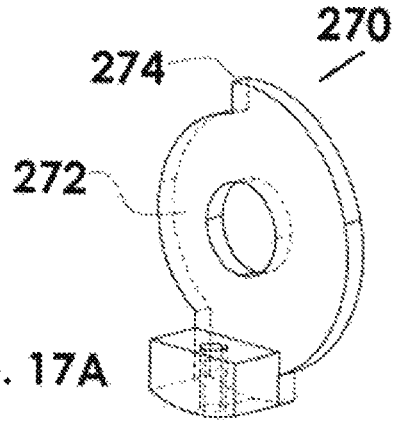
FIG. 17A is a perspective view of a release cam used in the latching mechanism of FIG. 15A.
Figure 17B:
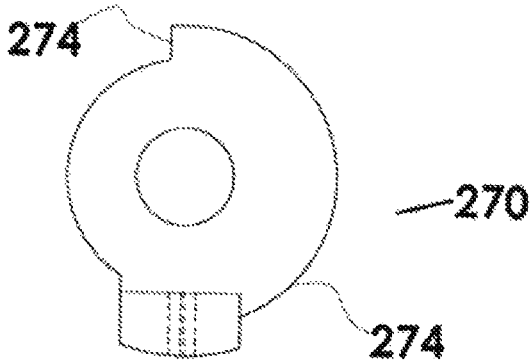
FIG. 17B is a side elevational view of the release cam shown in FIG. 17A.
Figure 17D:
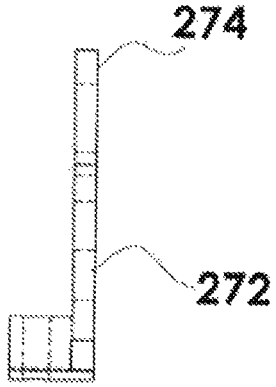
FIG. 17D is a side elevational view of the release cam shown in FIG. 17B, taken along line 17D-17D of FIG. 17B.

Referring now to FIGS. 15A-15C, latch release mechanism 260 is shown. Latch release mechanism 260 includes release initiator 124, a release cam 270, and a release linkage 280. Latch release mechanism 260 is used to bias lever on 246, away from cam lobes 236*a-c* in order to allow rotation of shaft 160, so that a user link 130 can be extended from handle 110.

Referring now to FIGS. 16A-16D, release initiator 124 is used by the user to pivot release cam 270 about shaft 160 such that pivot release cam 270 pushes lever arm 246, away from cam lobes 236*a-c* in order to disengage latch 240 from cam 230. Release initiator 124 can have a generally arcuate profile with an inside contour 264 having a profile adapted to slidingly engage along the exterior of handle 110. Alternatively, release initiator 124 can have other shapes and could be designed to roll, depress, etc. to engage on handle 110.

An outwardly extending protrusion 266 provides an engagement surface for user to operate switch 262 along the exterior of handle 110. A through passage 267 extends radially through release initiator 124 to accommodate insertion of release linkage 280 through switch 262 for engagement with release cam 270. An underside of release initiator 124, across from upwardly extending protrusion 266, includes a generally square or rectangular tang 268. Tang 268 fits into release opening 122 and handle 110. Tang 268 is radially smaller than release opening 122 so that tang 268 has a range of motion within release opening 122. In an exemplary embodiment, range of motion can be between about 30° and about 40°, although those skilled in the art will recognize that other ranges of motion can be used instead. Those skilled in the art will also recognize other designs can be used to release latching mechanism 210. Such designs may include a plunger/rod/piston or similar indexable linkage able to be actioned from and through handle 110 to bias latch 240 away from the path of the cam lobes 236*a-c*.

A bottom surface 269 of tang 268 can be generally arcuate to match with top surface 272 of release cam 270, which is shown in FIGS. 17A-D. Release cam 270 includes a generally annular body 272 having an inner diameter sized to allow release cam 270 to slide over shaft 160. Additionally, body 272 has at least one cam lobe 274 extending outwardly therefrom. User actuates release latching mechanism 280 (via release initiator 124) to action cam lobe 274 to engage lever arm 246 in order to bias lever arm 246, away from cam lobes 236*a-c* when pulling user link 130 from handle 110 (thereby unwinding user link 130 from spool 142). As shown in FIG. 3, in an exemplary embodiment, cam lobes 236*a-c* extend in opposite direction from cam lobe 274.

Further, top surface 272 of release cam 270 includes an opening 276 (shown FIG. 17C) sized to receive release linkage 280. Release linkage 280 is used transmit force and/or moment to release initiator 124 to release cam 270, although those skilled in the art will recognize that other mechanisms and securing means can be used to secure release initiator 124 to release cam 270.

A tapered helical spring 290 is disposed over shaft 160 within latching support housing 212 interior of release cam 270. Alternatively, spring 290 can be a different type spring, such as, for example, a coil spring. Spring 290 biases release cam 270 against axial face of cam 230 to cause frictionally coupled, but not locked, rotation between release latch 240 and release cam 270. Such operation causes release cam 270 to displace latch 240 from contacting cam 230 when user link 130 is rewinding onto spool 142 and into handle 110. In an exemplary embodiment, spring 290 is generally conical, with a taper diameter, in order to allow greater compression of spring 290 over a shorter axial distance.

An exemplary assembly of stretching apparatus 100 will now be discussed. The order of assembly described below is not necessarily performed in the order described, however, those skilled in the art, will recognize the described method, along with potential alternative methods and orders of assembly.

Link retracting mechanism 140 is formed by inserting fixed end 132 of user link 130 between first end 144 and second end 146 of spool 142. Linkage pin 158 is inserted through through-holes 154, 156 in first end 144 and second end 146, respectively as well as through the loop of fixed end 132, such that at least a portion of the loop of fixed end 132, and linkage pin 158 extends into slot 152. Linkage pin 158 can be secured to spool 142 in a known manner, such as by welding, peening, or other method. Linkage pin 158 serves to secure user link 130 to spool 142.

Spool 142 is slid over shaft 160 and is located between second peripheral groove 168 and third peripheral groove 174 on shaft 160. Spool 142 is secured to 160, such as, for example, by welding, keying, or other connecting mechanism such that spool 142 and shaft 160 rotate together. Spool 142 and shaft 160 could also be integrally formed.

Spring assembly 180 is formed by inserting the rewind spring 190 into support housing 182, such that outer end 194 of spring 190 is inserted through slot 186 in support housing 182 such that, when user link 130 is extended outwardly from handle 110 (unwound from spool 142), spring 190 is wound around shaft 110. Optionally, outer plate 196 can be affixed to support housing 182, such that spring 190 is secured within support housing 182. Alternatively, outer plate 196 can merely be held in place adjacent to support housing 182. Bushing 200 is installed through through-opening 186 in inner and plate 184 of support housing 182.

Spring assembly 180 is slid over second end 164 of shaft 160 such that inner end 192 of rewind spring 190 extends through slot 170 in shaft 160. C-clips 208 or other devices used to restrict axial movement are inserted into first peripheral groove 166 and second peripheral groove 168 of shaft 160 to axially secure spring assembly 180 on shaft 160, yet still allow spring assembly 180 to be able to rotate about shaft 160.

Latching mechanism 210 is formed by inserting latch 240 and torsion spring 250 into latching support housing 212, and sliding latch pin 248 through first latch pin opening 217, opening 244 in latch 240, torsion spring 250, and second latch pin opening 219 such that latch 240 and torsion spring 250 are supported within latching support housing 212. Torsion spring 250 transmits force and or torsion between inside of support housing 212 and latch 240. Latch pin 248 can be secured to latching support housing 212, such as, by welding, peening, or other known method. Second bushing 200 is inserted into through-opening 216 in latching support housing 212.

C-clip 208 is inserted into third peripheral groove 174 in shaft 160 and latching mechanism 210 is slid over shaft 160 until latching mechanism 210 engages C-clip 208. In third peripheral groove 174. Helical spring 290, release cam 270, and cam 230 are inserted into latching support housing 212. Cam 230 is aligned with shaft 160 such that hole 176 in shaft 160 is aligned with through-hole 233 in cam 230 so that a screw (not shown), or other securing means can be inserted through through-hole 233 and into hole 176 to fixedly secured cam 230 to shaft 160. Additionally other forms of fixing and location of cam 230 to shaft 160 can be used.

With user link 130 fully wound onto spool 142, the entire link retracting mechanism 140 is then slid (generally holes 188 and 182 are angularly aligned with holes 126 and 127 in handle 110 before sliding retracting mechanism 140 into handle 110) through first end 112 of handle 110 until opening 188 in support housing 182 is aligned with through opening 127 in handle 110 and hole 220 in latching support housing 212 is aligned with opening 126 in handle 110 and user link 130 is aligned with slot 139 (the alignment of user link 130 with slot 139 is generally true but user link 130 can be manipulated through slot 139 even if not exactly aligned). Outer end 194 of spring 190 is located between support housing 182 and the interior of handle 110. Screws 129 are inserted through each of openings 126, 127 to secure link retracting mechanism 140 within handle 110.

User link 130 is extended outward from handle 110 through guide opening 128 by applying tensile force on loop 136 of user link 130 to unwind a portion of user link 130 from spool 142. User link 130 is also inserted through slot 139 in guide 137 and guide 137 is secured to handle 110.

Additionally, opening 276 in release cam 270 is aligned with opening 122 and release initiator 124 is inserted over opening 122, such that release linkage 280 can be inserted through release initiator 124, and into opening 122 to secure release cam 270 to release initiator 124.

A latching mechanism 310 according to an alternative exemplary embodiment of the present invention is shown in FIGS. 18A-18D. With latching mechanism 310, release initiator 124, release latch 240 and release linkage 280 are omitted and replaced with switch 324 (shown in detail in FIG. 18B).

Figure 18A:
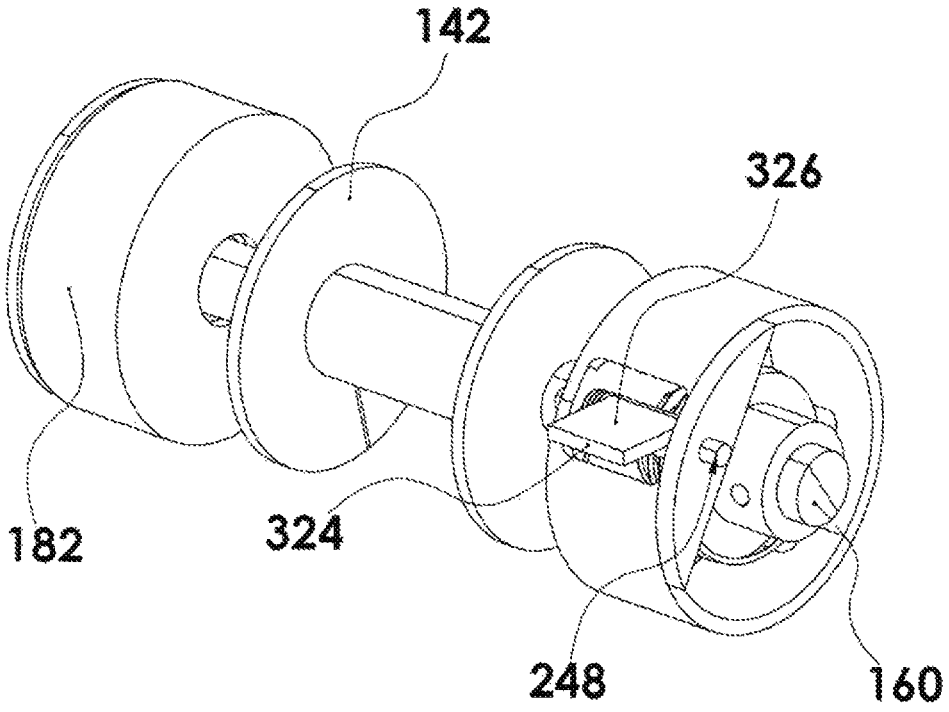
FIG. 18A is a perspective view of an alternative exemplary embodiment of a latching mechanism for use with the stretching apparatus shown in FIG. 1.
Figure 18B:
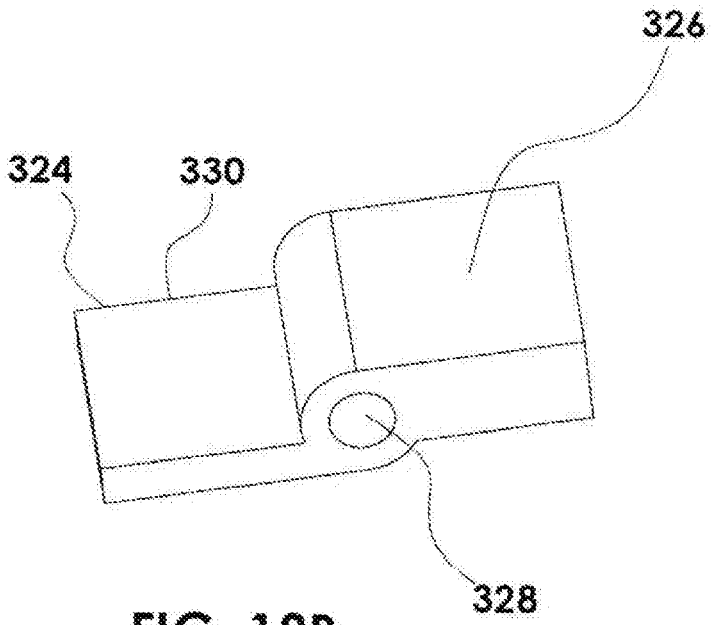
FIG. 18B is a perspective view of a tab used with a locking mechanism shown FIG. 18A.
Figure 18C:
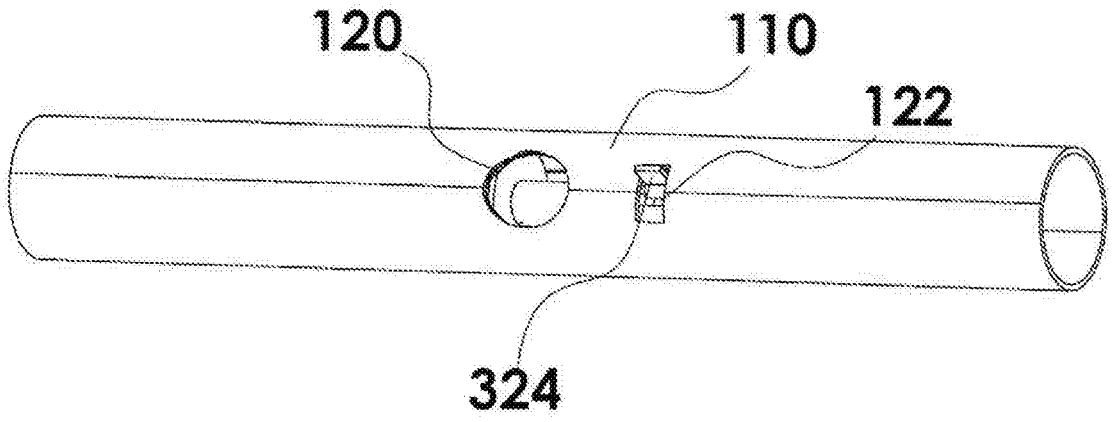
FIG. 18C is a top plan view showing the latching mechanism of FIG. 18A inserted into handle of the stretching apparatus shown in FIG. 1.
Figure 18D:
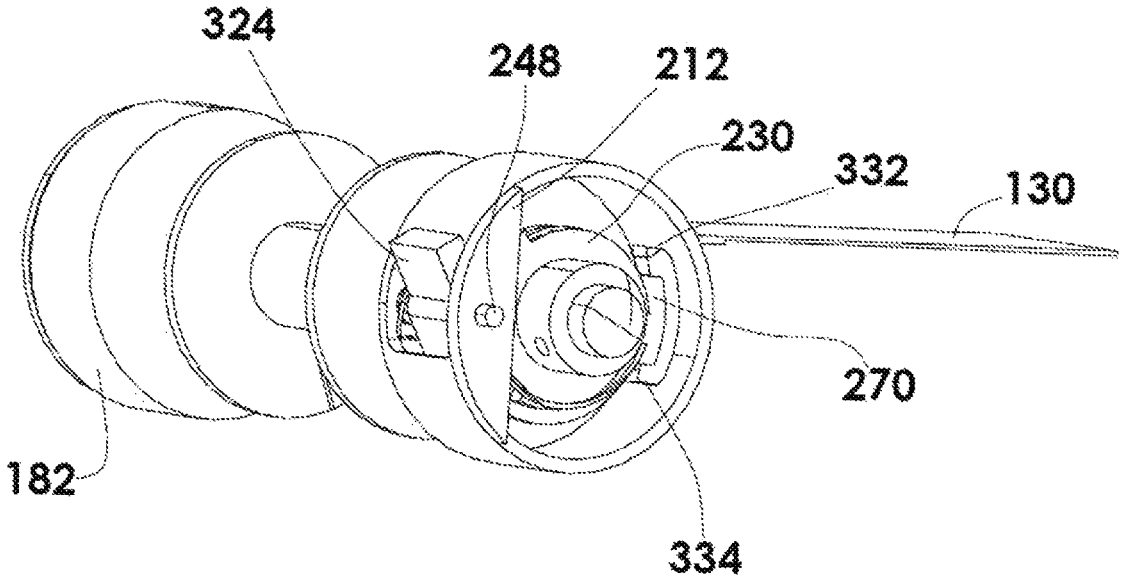
FIG. 18D is a perspective view, partially cutaway, of the latching mechanism for use with the stretching apparatus shown in FIG. 1.

Switch 324 includes an extension tab 326 that extends outwardly from opening 222 in support housing 212. As shown in FIG. 18D, support housing 212 is rotated relative to user link 130 such that opening 222 is directly aligned with opening 122 in handle 110, allowing switch 324 to extend outwardly from opening 122, as shown in FIG. 18C. Those skilled in the art recognize that the switch 324 may or may not extend outwardly beyond the diametrical surface 116 of handle 110. The option to design tab 326 of switch 324 to fully reside inside of the diametrical limits of handle 110 is one embodiment. Another embodiment is to design tab 326 of switch 324 to extend beyond diametrical surface 116 (external diameter of handle 110) as shown in FIG. 18D.

Switch 324 also includes a through-opening 328, through which pin 248 extends to support switch 324 on support housing 212, and to allow switch 324 to pivot about pin 248. A latch 330 extends distally from extension 326 and is used to directly releasably engage with one of cam lobes 236*a-c* to restrict rotation of shaft 160 only in a direction that would allow extension of user link 130. Cam 270 is rotated to an approximate location as shown in FIG. 18D. Optionally, stops 332, 334 can be added to the interior of support housing 212 in order to limit the angular rotation of cam 270. Those skilled in the art will recognize that the function of switch 324 can be performed by a component with geometry differing from the illustrated geometry shown of switch 324. Those skilled in the art will also recognize that the functionality of switch 324 can be performed by multiple components, such as, for example, a linkage, button, or other latching means for engagement or releasing of said latch to cam lobes 236*a-c*. Those skilled in the art will also recognize that torsion spring 150 can be used with switch 324 to provide bias of latch 330 towards engagement of cam lobes 236*a-c*. Additionally, those skilled in the art will recognize that other spring types, spring geometries, and geometries of engagement for said biasing of switch 324 may be used perform similar function as torsion spring 250, the biasing of switch 324 into cam lobes 236*a-c* or similar latching mechanism.

Figure 19:
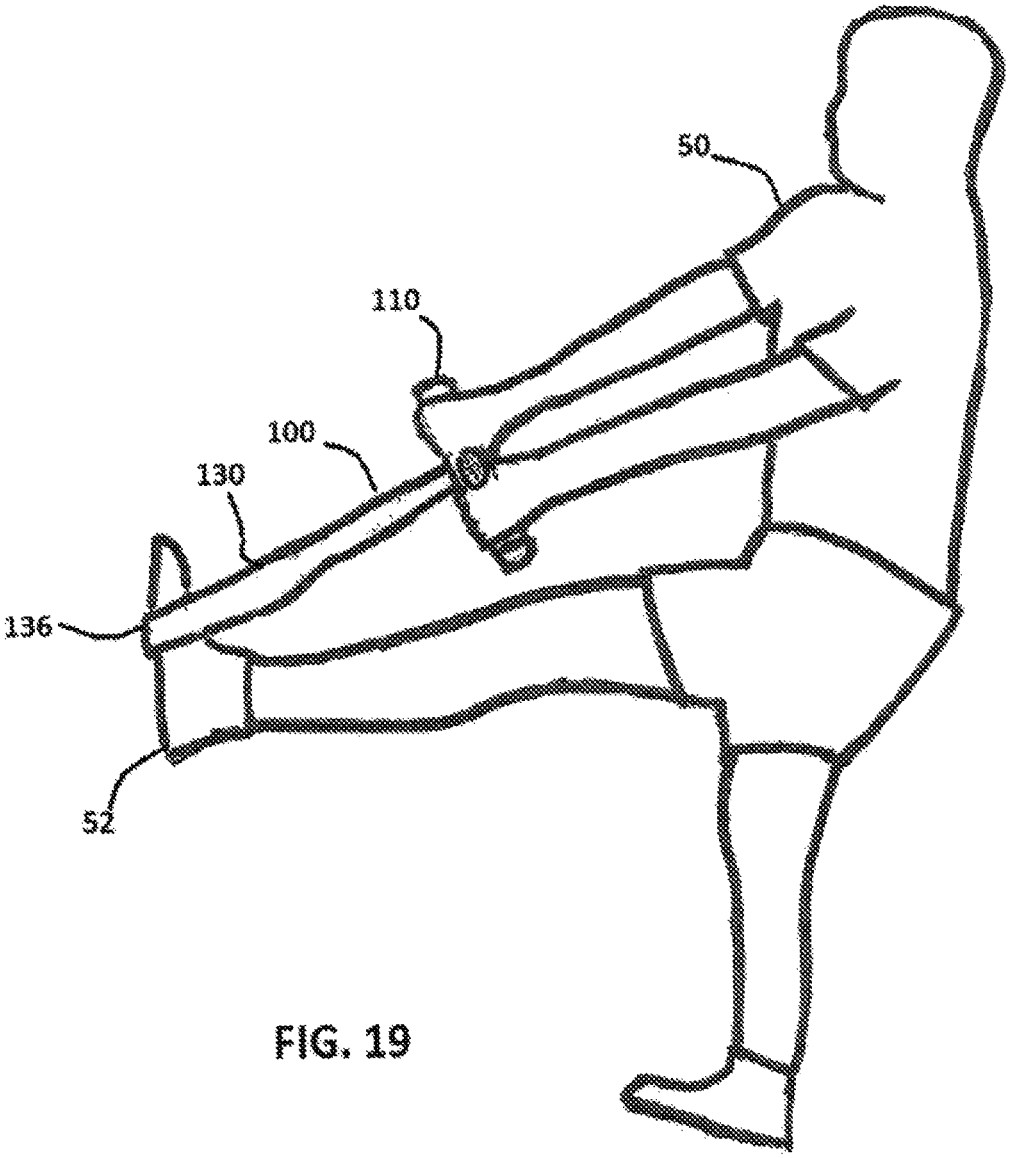
FIG. 19 shows a perspective view of the apparatus shown in FIG. 1 being used by a user.

To operate stretching apparatus 100 (using latching mechanism 210), as shown in FIG. 19, a user 50 grips handle 110 and operates release initiator 124 on or through handle 110 so that release cam 270 biases latch 240 away from cam 230, allowing user link 130 to be extended from handle 110 (via unwinding user link 130 from spool 142). The user then inserts an appendage (although the user can also insert the appendage prior to above action of release initiator 124), such as user's foot 52, into loop 136, and extends user link 130 from handle 110 with appendage (with retracting mechanism 140 in release mode) 52, further tightening rewind spring 190 around shaft 160. As user link 130 is extended from handle 110, spool 142 rotates shaft 160 such that rewind spring 190 tightens around shaft 160, storing energy therein.

After user 50 has extended user linkage 130 a desired length or its maximum length, user 50 releases release initiator 124, allowing latch 240 to bias toward and engage one of cam lobes 236*a-c*, preventing further extension of user link 130 from handle 110. At this point, the user 50 can perform desired stretching exercises with dressing apparatus 110. During stretching, tensile force travels along user link 130, such that the force translates into force and moment in spool 142 and shaft 160. Force transmits from shaft 160, into the support housings 182 and 212 and into handle 110 and is balanced by user's hands and arms. Force and moment are also transmitted from cam 230 through latch 240 into latch pin 248, into latch support housing 212 and into handle 110. These forces and moments are also balanced by user's hands and arms during use. The use of both hands and arms for this device 100 provides for generally balanced force and moment between a user's hands and arms. After the user performs the exercises, the user 50 removes his/her appendage 52 from loop 136. The stored energy in rewind spring 190 is released, allowing rewind spring to rotate shaft 160 to withdraw user link 130 back into handle 110. Optionally, the user 50 could also allow or activate user link 130 to wind back into handle 110 while user link 130 is still connected to user's appendage 52. Then user 50 can remove appendage 52 from user link 130.

An alternative embodiment of a stretching device or apparatus 300 is shown in FIGS. 20-23A, with views of an exemplary link spool/retraction device 302 shown in FIGS. 23A and 24-27.

FIGS. 28-31 show a hollow handle 306 in which link spool/retraction device 302 is contained (as shown in FIGS. 20-23). Handle 306 can be tubular and can be constructed from steel, aluminum, polymer, or other suitable material. Handle 306 has a flexible member through-opening 312, a latch through-opening 314, and an indicia viewing through-opening 316 formed therein. A through-opening 315 is used to secure handle 306 to a shaft support 320.

While exemplary handle 306 is elongated and tubular, those skilled in the art will recognize that handle 306 can take other shapes, such as, for example, the hand grip disclosed in U.S. Pat. No. 6,210,348 to Reed. Other shapes for handle 306 are also contemplated and the shape of exemplary handle 306 is not limited by the depicted handle.

FIGS. 32-35 show a shaft support 320 mounted in handle 306. In an exemplary embodiment, shaft support 320 can be generally centrally mounted in handle 306. Shaft support 320 has a first wall 322 and a second wall 325, distal from first wall 322. A spacer member 327 spaces first wall 322 from second wall 325. Spacer member includes a mounting hole 328 extending therethrough so that shaft support 320 can be fixedly mounted to through-opening 315 in handle 306 with a securing device, such as a screw or any suitable type of securing device (not shown).

First wall 322 can have a generally circular outer perimeter and is sized to fit within the generally circular inner perimeter of tubular handle 306. First wall 322 also includes a tang 330 that extends outwardly therefrom, away from second wall 325. Tang 330 is used to engage an end of a biasing member, as will be discussed in more detail later herein. First wall 322 includes a radially extending notch 332 formed in the outer perimeter of wall 322 that is used to engage a release washer 410 (shown in detail in FIGS. 52-55).

First wall 322 also includes a generally hourglass shaped notch 336 located around the perimeter of first wall 322 such that, when shaft support 320 is mounted within tube 310, latch 440 (specifically outwardly extending portion 448) is aligned with latch through-opening 314. Notch 336 pivotally supports a first end 444 of a latch member 440 (shown in FIGS. 59-62). Notch 336 includes an opening 337 that allows for insertion of latch 440 into notch 336. First wall 322 also includes a through-opening 334 that can be formed in a generally central portion of first wall 322, although, in an exemplary embodiment, through-opening 334 is generally off-center of first wall 322.

Second wall 325 is similar to first wall 322, with a generally circular outer perimeter, a generally hourglass-shaped notch 338 for a second end 446 of latch member 440, and a generally off-centered through-opening 340 that extends coaxially with through-opening 334. Second wall 325 also includes a plurality of radially spaced through-openings 342 that are used to securably connect a biasing member retainer 380 (shown in detail in FIGS. 44-47).

Referring now to FIGS. 36-39, a shaft 350 extends through both of through-opening 334 and through-opening 340 such that shaft 350 is mounted on shaft support 320. Shaft 350 rotatably supports a spool 360 (shown in detail in FIGS. 40-43), through which shaft 350 extends. Shaft 350 has a first end 352 that extends through first wall 322. First end 352 includes a notch 354 that is used to retain a C-clip 355 or other suitable axially stopping device (shown in FIG. 23A) to securably retain shaft 350 to shaft support 320. First end 354 uses a shoulder 357 to act as an axial stopping means such that shaft 350 and specifically first end 354 will only allow diametrically smaller portion of shaft 354 to extend through through-opening 334. First end 354 also includes a flat 356 that is used to engage with a corresponding flat in a spool 360 (shown in FIGS. 40-43). A second end 358 extends through second wall 325. Second end 358 includes an axially extending slot 359 that is used to secure first end 192 of biasing member 190 (shown in detail in FIGS. 8A-8D).

Figure 23A:
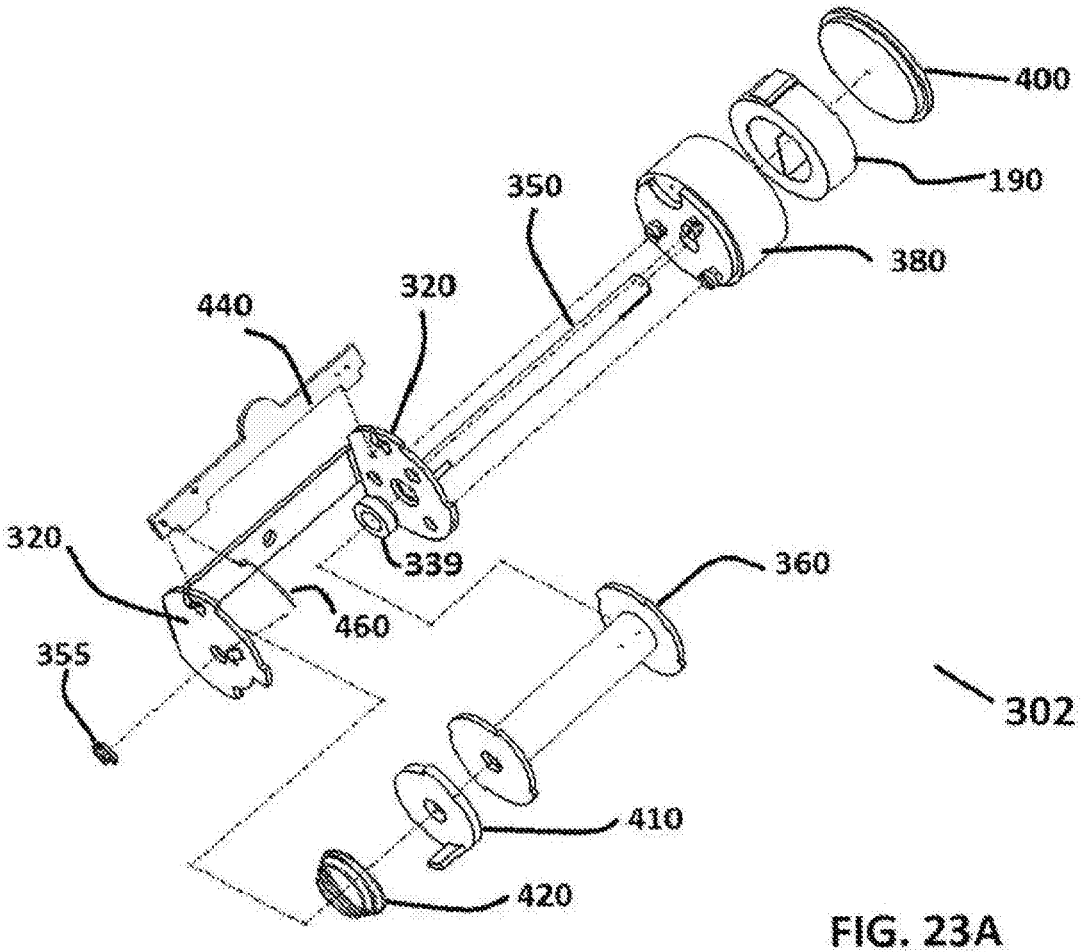
FIG. 23A is an exploded view of the device shown in FIG. 20.
Figure 28:
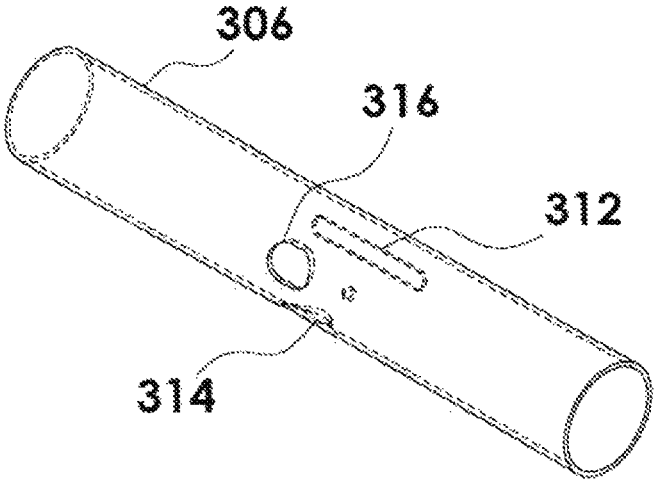
FIG. 28 is a perspective view of a handle used with the device shown in FIG. 20.
Figure 30:
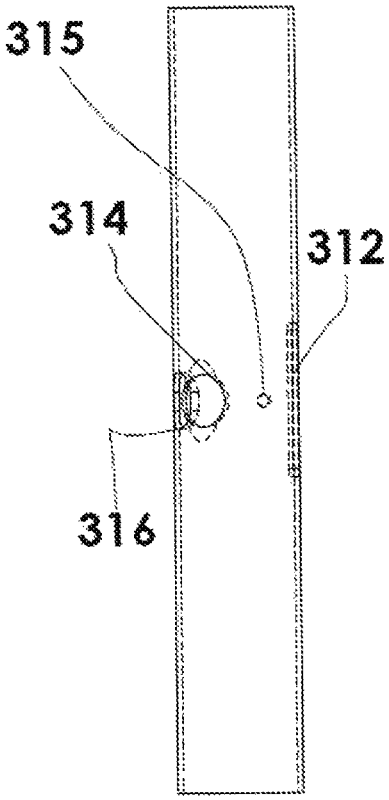
FIG. 30 is a top plan view of the handle shown in FIG. 28.
Figure 29:
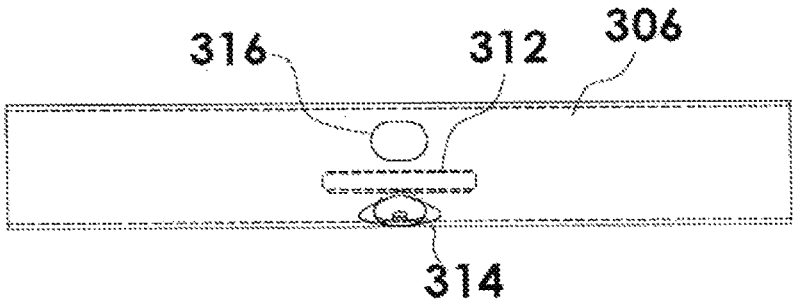
FIG. 29 is a rear elevational view of the handle shown in FIG. 28.
Figure 31:
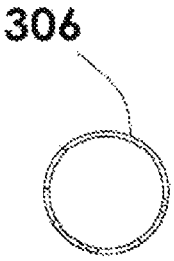
FIG. 31 is a side elevational view of the handle shown in FIG. 28.
Figure 32:
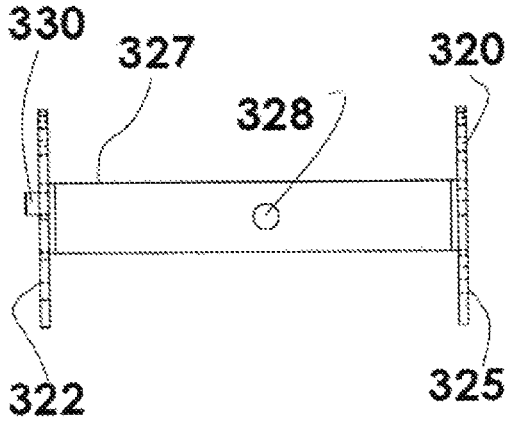
FIG. 32 is a top plan view of a shaft support used with the device shown in FIG. 20.
Figure 34:
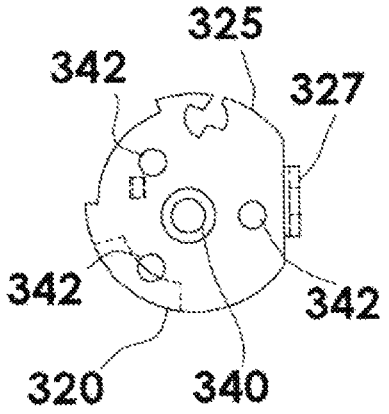
FIG. 34 is a side elevational view of the shaft support shown in FIG. 32.
Figure 33:
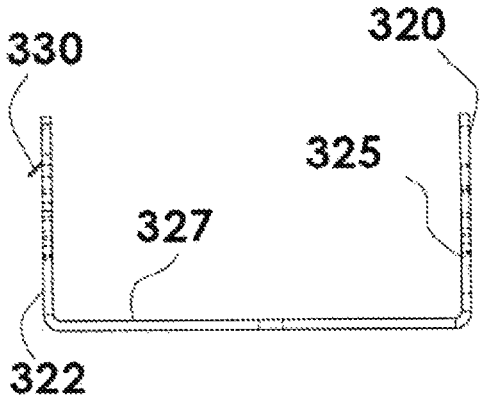
FIG. 33 is a front elevational view of the shaft support shown in FIG. 32.
Figure 35:
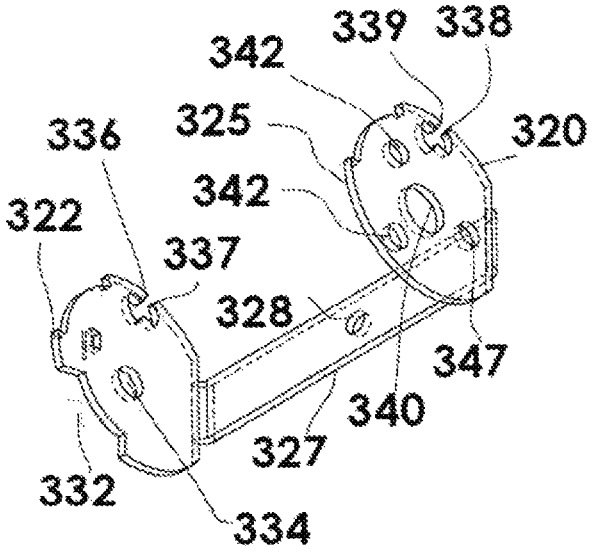
FIG. 35 is a perspective view of the shaft support shown in FIG. 32.
Figure 39:
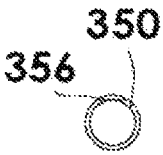
FIG. 39 is a side elevational view of the shaft shown in FIG. 36.
Figure 37:
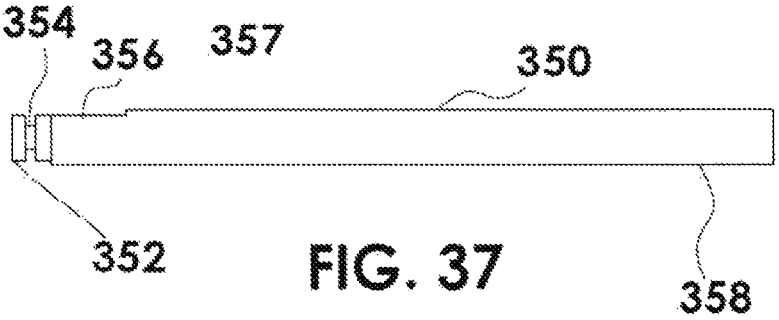
FIG. 37 is a front elevational view of the shaft shown in FIG. 36.
Figure 38:
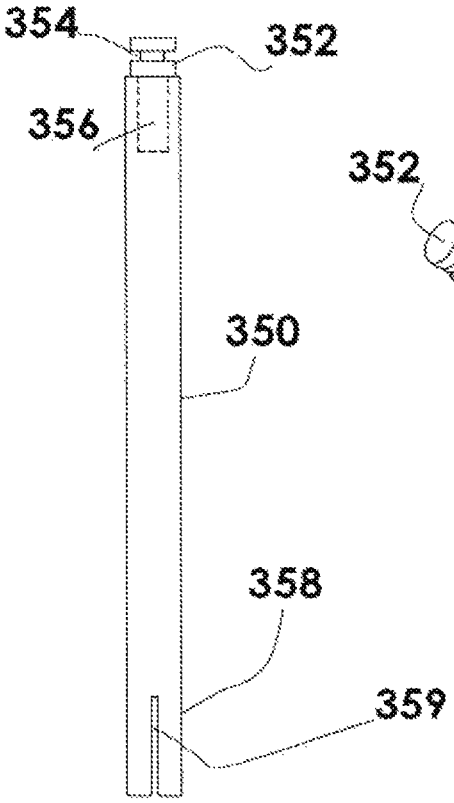
FIG. 38 is a top plan view of the shaft shown in FIG. 36.
Figure 36:
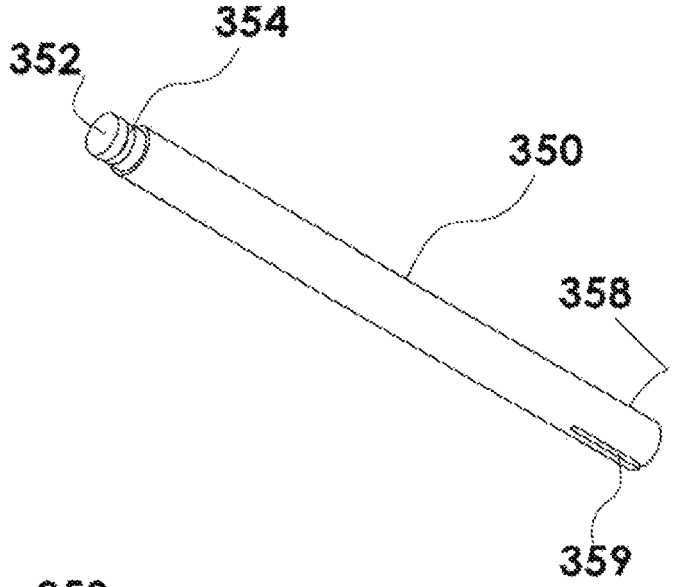
FIG. 36 is a perspective view of a shaft used with the device shown in FIG. 20.
Figure 40:
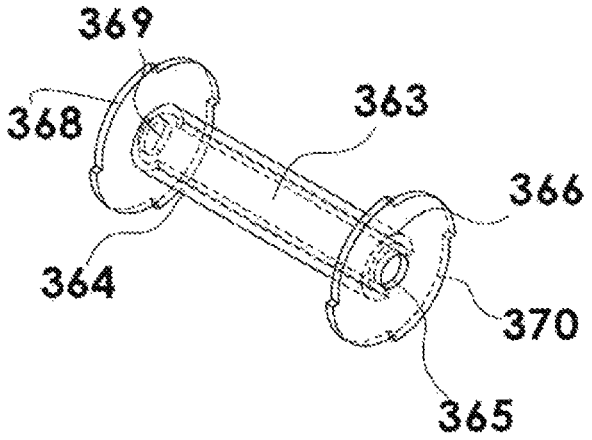
FIG. 40 is a perspective view of a spool used with the device shown in FIG. 20.
Figure 42:
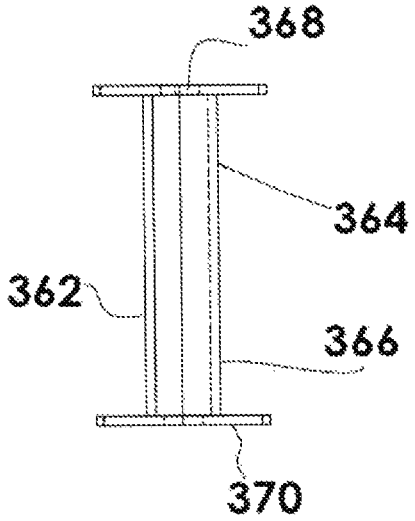
FIG. 42 is a top plan view of the spool shown in FIG. 40.
Figure 41:
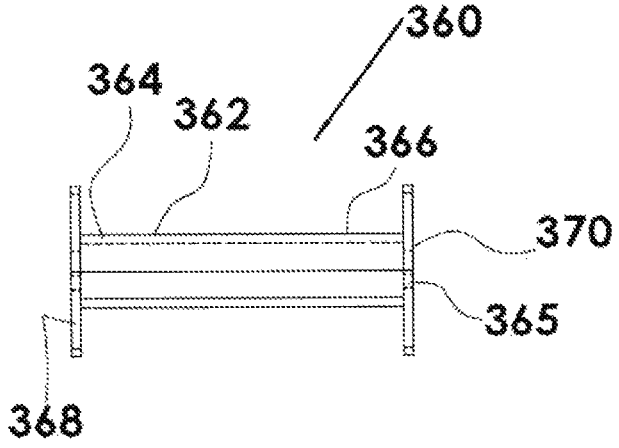
FIG. 41 is a front elevational view of the spool shown in FIG. 40.

Referring to FIG. 23A, an annular bushing 359 is inserted into through-opening 340 in shaft support 322. Bushing 359 can be made from a polymer, such as, for example, nylon, or other suitable low-friction material to support shaft 350 in shaft support 320 and to also allow shaft 350 to rotate freely within shaft support 320. It is desired that bushing 359 does not extend outside of first wall 322 of shaft support 320.

Referring to FIGS. 40-43, spool 360 is mounted on shaft 350. Spool 360 is mounted between first wall 322 and second wall 325 of shaft support 320. Spool 360 comprises a spool shaft 362 having a first spool shaft end 364 and a second spool shaft end 366. Spool shaft 362 includes a longitudinal opening 363 that extends between first spool shaft end 364 and second spool shaft end 366. A first end wall 368 is connected to first shaft end 364 and a second end wall 370 connected to the second shaft end 366.

Spool shaft 362 has an axially-centered spool through-opening 365 such that shaft 350 extends through spool through-opening 365, allowing spool 360 to be rotatably mounted on shaft 350 within handle 306. Spool through-opening 365 at first end wall 368 includes a flat 369 that engages with flat 356 on shaft 350 so that flats 369, 356 form a "key" so that spool 360 rotates with shaft 350.

Spool shaft 362 also includes an opening, or slot 364 extending between first spool shaft end 364 and second spool shaft end 366. Slot 364 allows a flexible member, such as a user link 130 (shown in FIG. 2) to be inserted thereinto.

Figure 43:
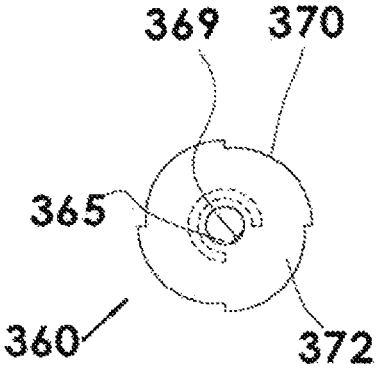
FIG. 43 is a side elevational view of the spool shown in FIG. 40.
Figure 46:
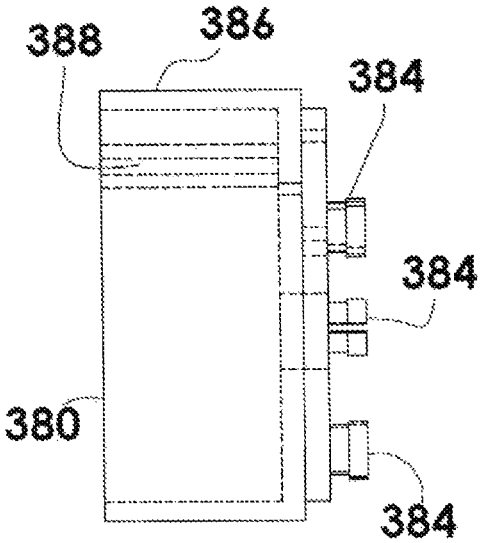
FIG. 46 is a top plan view of the retainer shown in FIG. 44.
Figure 47:
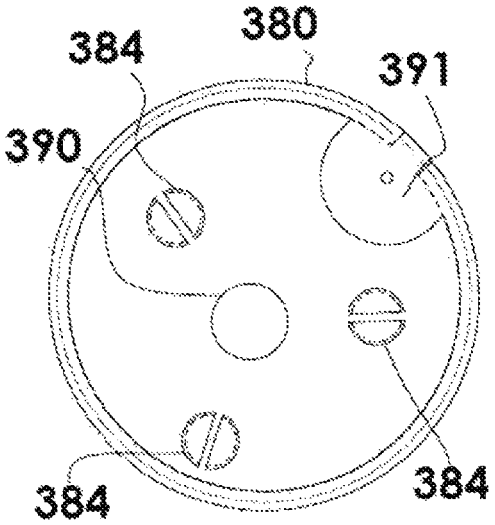
FIG. 47 is a side elevational view of the retainer shown in FIG. 44.
Figure 44:
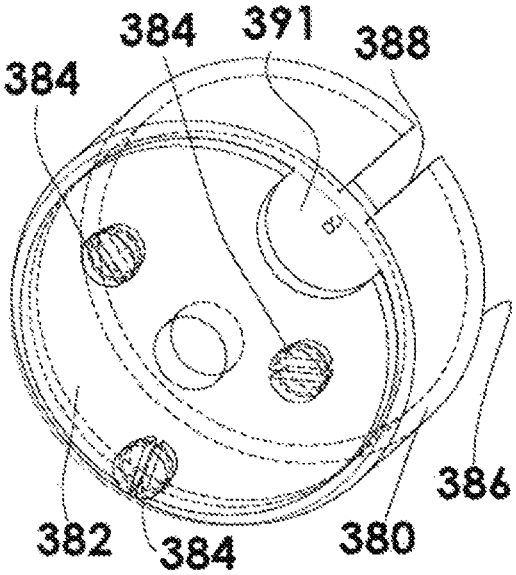
FIG. 44 is a perspective view of a biasing member retainer used with the device shown in FIG. 20.
Figure 45:
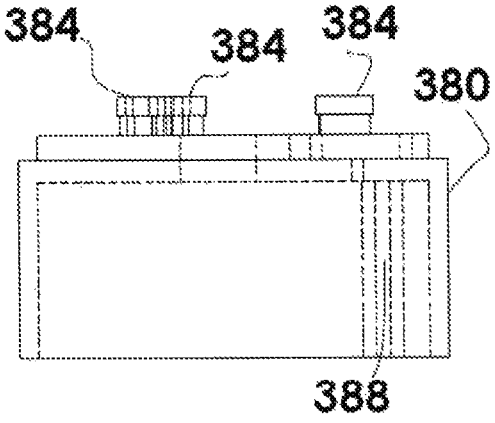
FIG. 45 is a front elevational view of the retainer shown in FIG. 44.
Figure 48:
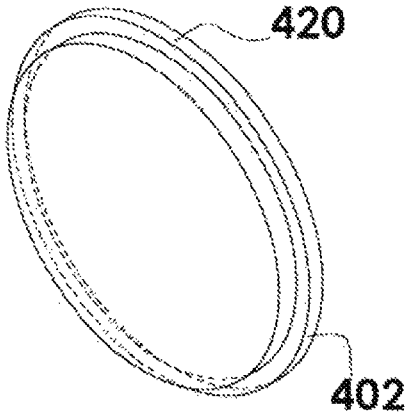
FIG. 48 is a perspective view of a retainer cover used with the device shown in FIG. 20.
Figure 49:
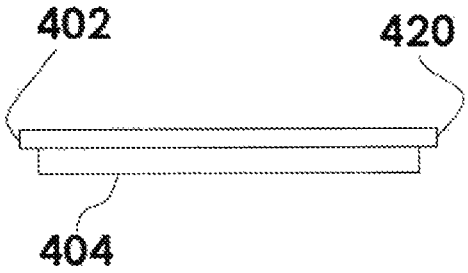
FIG. 49 is a top plan view of the retainer cover shown in FIG. 48.
Figure 50:
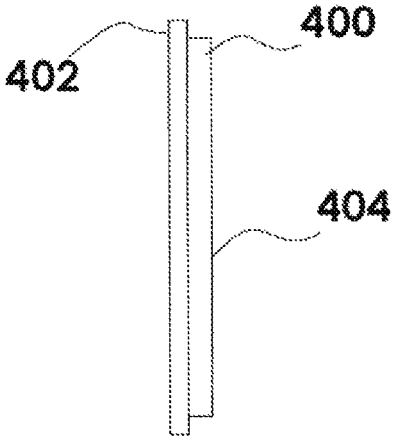
FIG. 50 is a front elevational view of the retainer cover shown in FIG. 48.
Figure 51:
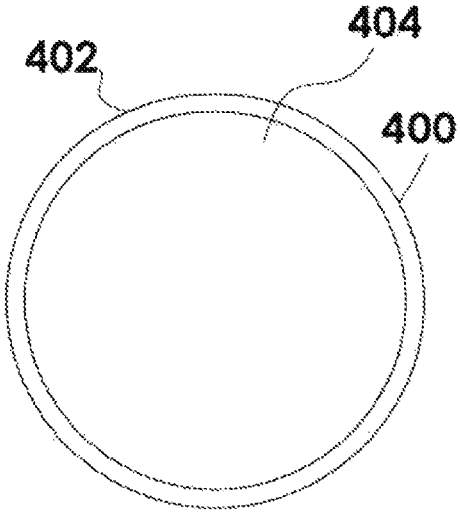
FIG. 51 is a side elevational view of the retainer cover shown in FIG. 48.
Figure 53:
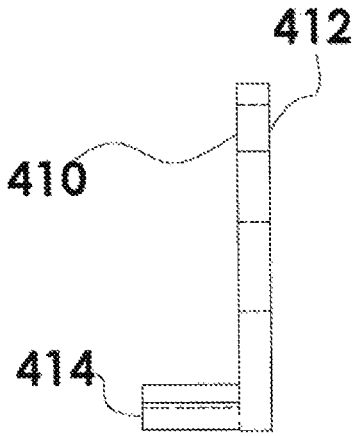
FIG. 53 is a front elevational view of the release washer shown in FIG. 52.
Figure 52:
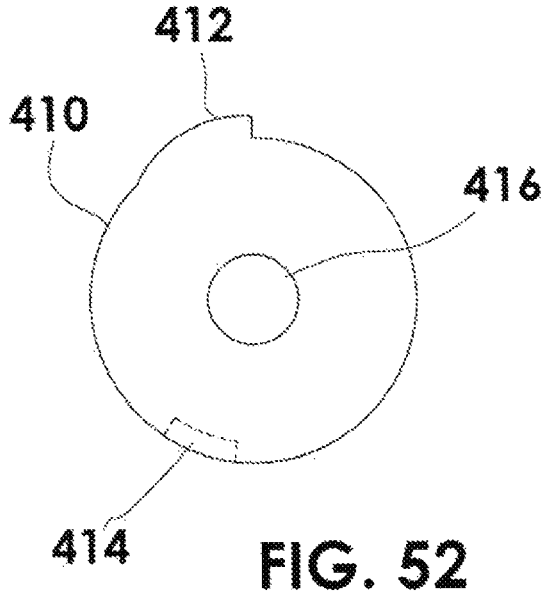
FIG. 52 is a side elevational view of a release washer used with the device shown in FIG. 20.
Figure 55:
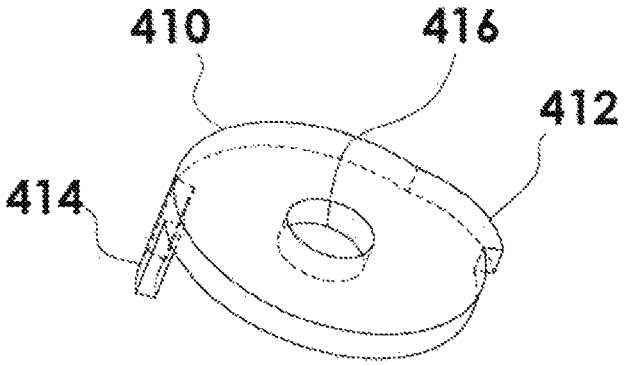
FIG. 55 is a perspective view of the release washer shown in FIG. 52.
Figure 54:
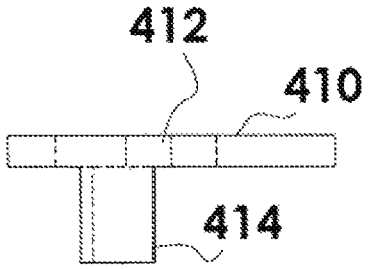
FIG. 54 is a top plan view of the release washer shown in FIG. 52.

First end wall 368 and second end wall 370 each comprise at least one cam, or latch engagement, face 372, shown in FIG. 43 for simplicity. As shown in FIG. 43, four cam faces 372 are provided, although those skilled in the art will recognize that more or less than four cam faces 372 can be provided. Cam faces 372 are used to releasably engage a latch mechanism 440, shown in FIGS. 59-62.

Referring back to FIG. 24, biasing member 190 is disposed over second end 358 of shaft 350 such that first biasing member end 192 is engaged with shaft 350. As discussed above with respect to device 100, spool biasing member 190 is a spiral spring that can be wound between about 0 and about 40 turns. Biasing member 190 is adapted to rotate flexible member 130 around spool 360 when latching mechanism 440 is disengaged from the at least one of cam face 372.

Referring now to FIGS. 24 and 44-47, a retainer 380 is disposed over spool biasing member 190. Retainer 380 includes a side wall 382 having a first bayonet pin 384 is connected to one of first wall 322 and second wall 325 of shaft support 320. In an exemplary embodiment, a plurality of bayonet pins 384 each extends through one of the plurality of through-openings 342 in second wall 325 of shaft support 320.

Retainer 380 also includes a cylindrical wall 386 extending axially from side wall 382 that surrounds and retains spool biasing member 190 therein. Retainer 380 has a biasing member opening 388 formed in wall 386 that is adapted to receive second biasing member end 194 to extend therethrough to fix second biasing member end 194 to retainer 380. Also, a through-opening 390 extends through side wall 382 to allow shaft 350 to extend therethrough. Wall 386 also includes a cut-out 391 that provides a space for a latch mechanism 440 (shown in FIGS. 59-62) to extend past first sidewall 322 in shaft support 320 so that latch mechanism 440 does not bind or is not in contact with retainer 380 during operation.

Referring to FIGS. 48-51, a biasing member cover 400 can optionally be located on retainer 380. Biasing member cover 400 includes a lip 402 extending around a perimeter thereof with a generally circular body 404 that fixedly engages retainer 380 such as, for example, with a friction fit.

Figure 24:
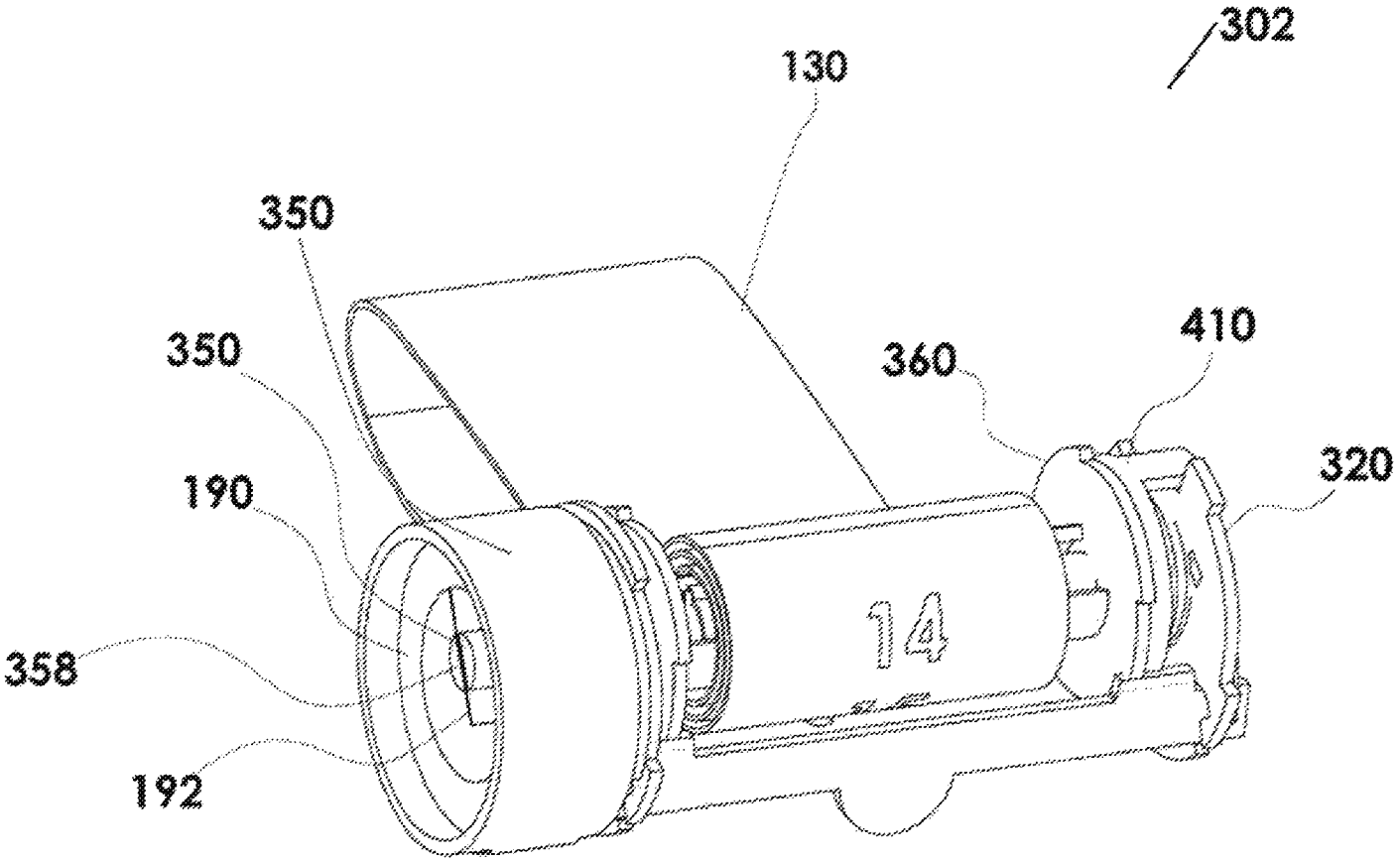
FIG. 24 is a left perspective view of an exemplary user link extension/retraction assembly used with the device shown in FIG. 20.
Figure 25:
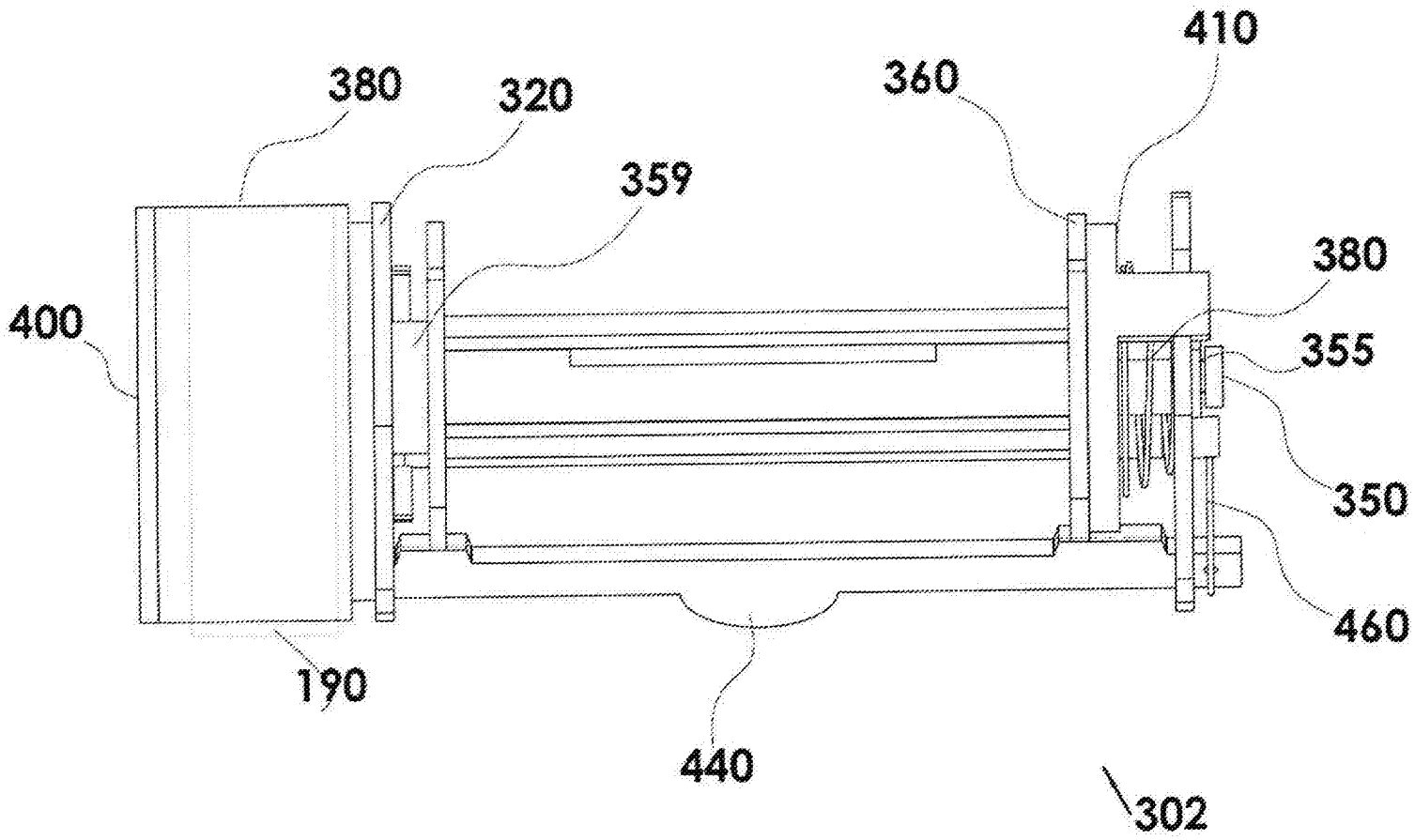
FIG. 25 is a top plan view of the user link extension/retraction device shown in FIG. 24.
Figure 26:
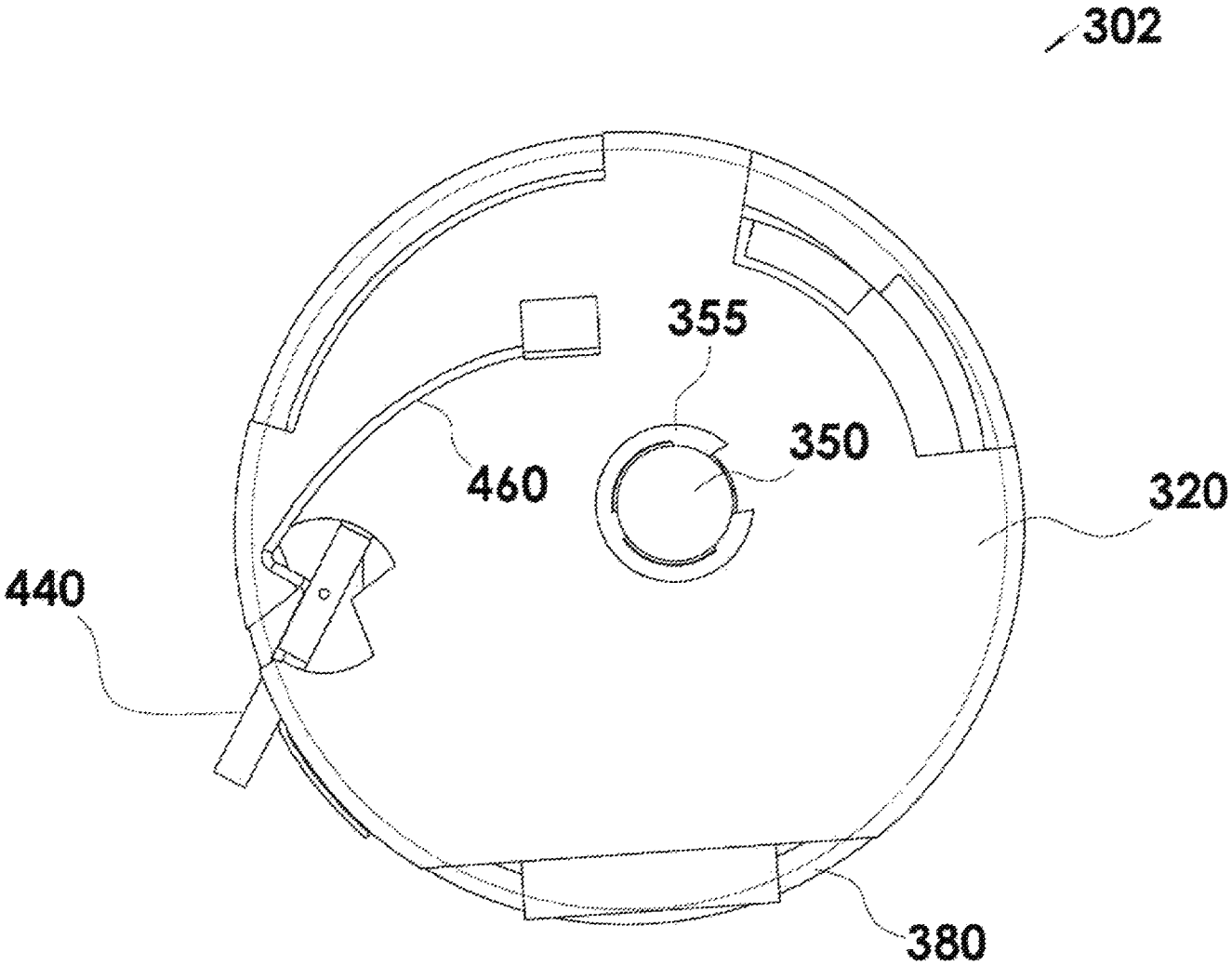
FIG. 26 is a side elevational view of the user link extension/retraction device shown in FIG. 24.
Figure 27:
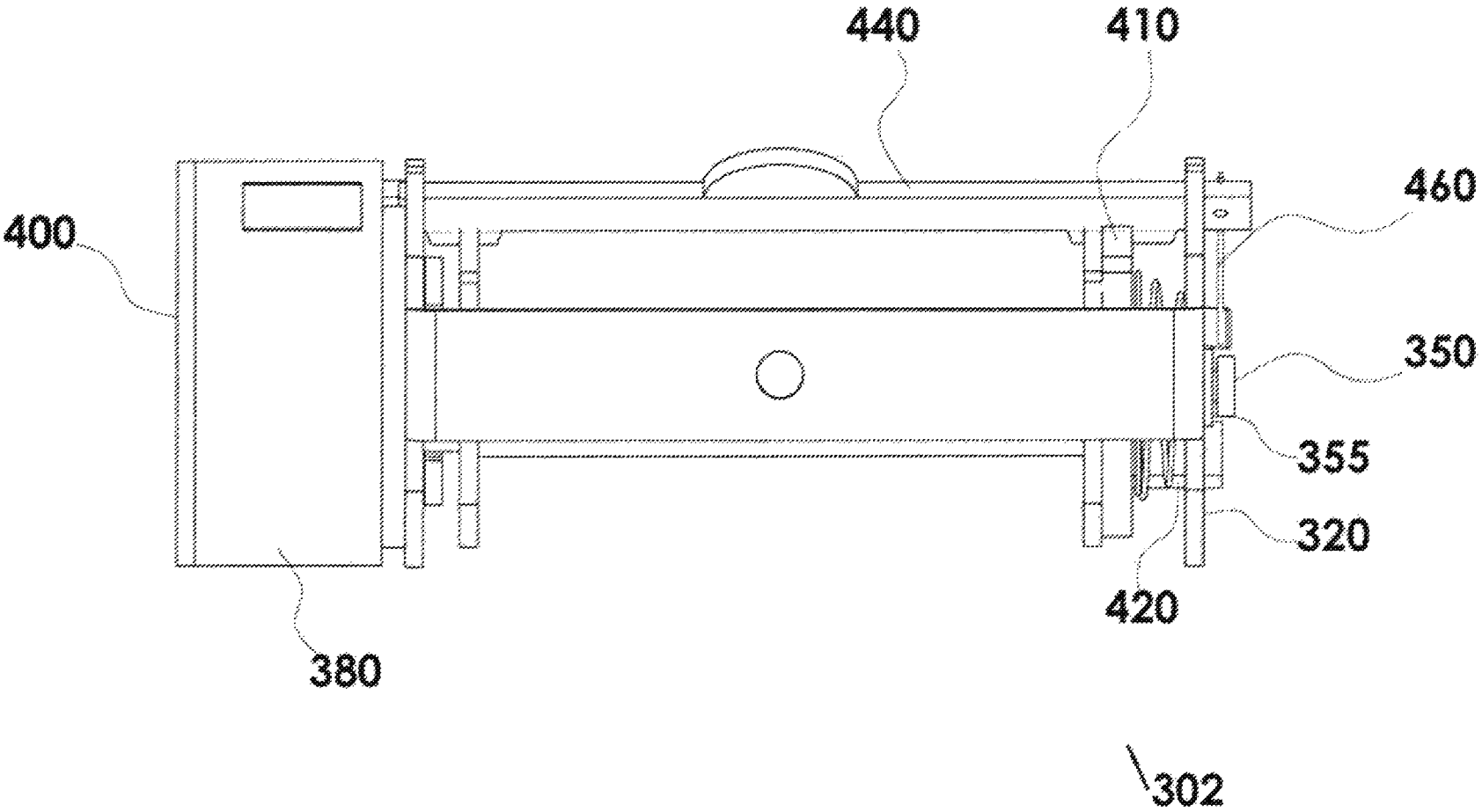
FIG. 27 is a bottom plan view of the user link extension/retraction device shown in FIG. 24.

As shown in FIG. 24, a release washer 410 is located between spool 360 and one of first wall 322 and second wall 325 of shaft support 320. In the example shown in FIG. 24, release washer 410 is located between spool 360 and second wall 325. Release washer 410 is used to bias tabs 450, 452 of latching mechanism 440 away from cam face 372 during the rewinding of user link 130 into handle 306.

As shown in detail in FIGS. 52-55, release washer 410 has a first tang 412 extending radially outwardly therefrom. Tang 412 is adapted to engage latch mechanism 440 (shown in FIG. 25). Release washer 410 also has a second tang 414 that extends axially outwardly therefrom and into notch 332 in first wall 322 of shaft support 320. Further, release washer 410 includes an axial through-opening 416 so that shaft 350 can slide therethrough and support release washer 410 thereon.

Figure 56:
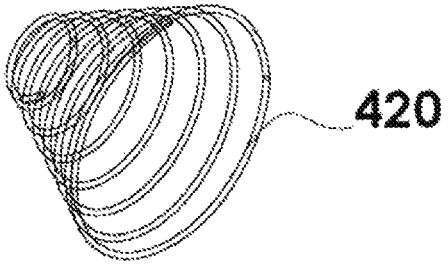
FIG. 56 is a perspective view of an axial spring used with the device shown in FIG. 20.
Figure 57:
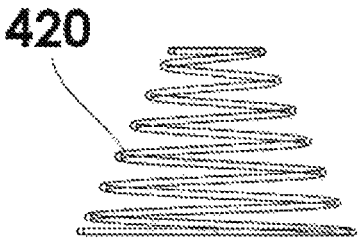
FIG. 57 is a side elevational view of the spring shown in FIG. 56.
Figure 58:
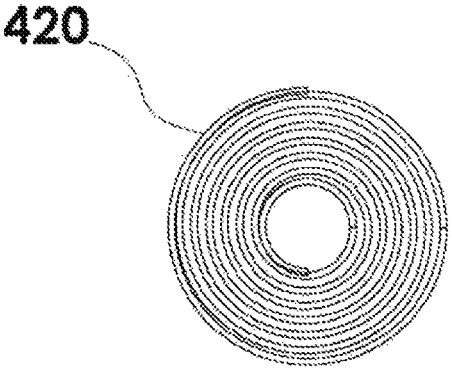
FIG. 58 is a top plan view of the spring shown in FIG. 56.
Figure 59:
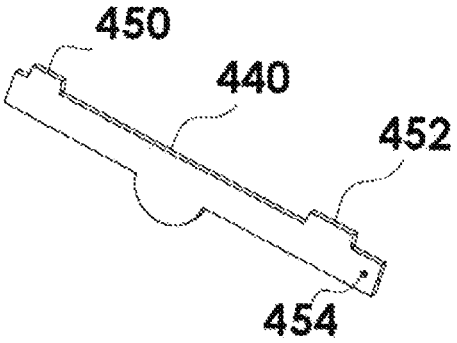
FIG. 59 is a perspective view of a latch mechanism used with the device shown in FIG. 20.
Figure 61:
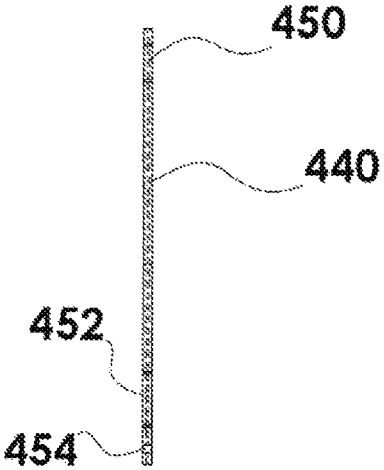
FIG. 61 is a top plan view of the latch mechanism shown in FIG. 59.
Figure 60:
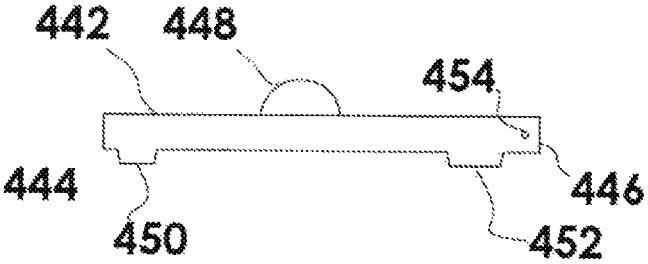
FIG. 60 is a front elevational view of the latch mechanism shown in FIG. 59.
Figure 62:
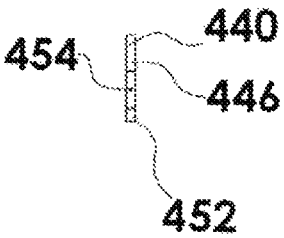
FIG. 62 is a side elevational view of the latch mechanism shown in FIG. 59.
Figure 65:
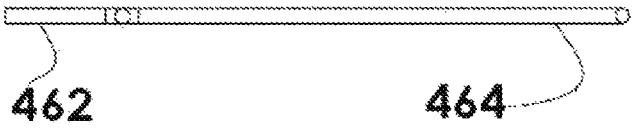
FIG. 65 is a top plan view of the latch spring shown in FIG. 63.
Figure 66:
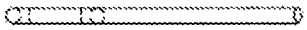
FIG. 66 is a side elevational view of the latch spring shown in FIG. 63.
Figure 63:
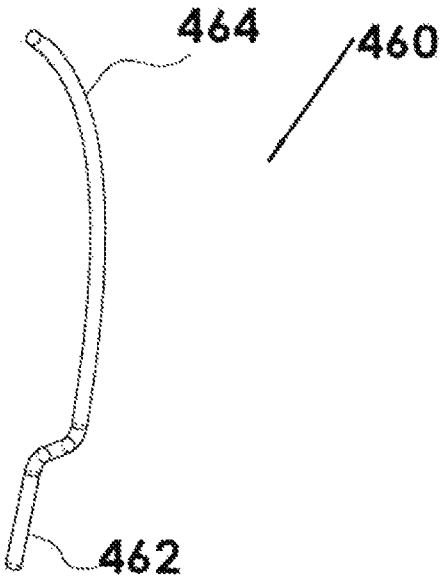
FIG. 63 is a perspective view of a latch spring used with the device shown in FIG. 20.
Figure 64:
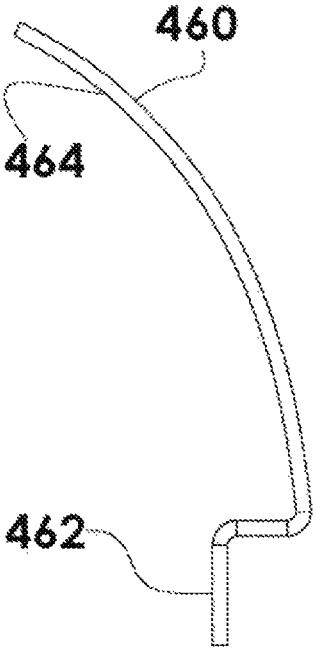
FIG. 64 is a front elevational view of the latch spring shown in FIG. 63.

Optionally, an axial spring 420, shown in detail in FIGS. 56-58 can be located between release washer 410 and the one of first wall 322 and second wall 325 of shaft support 320. Axial washer 420 is adapted to bias release washer 410 toward spool 360 to frictionally couple release washer 410 and spool 360 to reduce noise and chatter of release washer 410 when spool 360 is rotating. Additionally, axial spring 420 also biases spool 360 toward and against first wall 322 of shaft support 320 to relieve an axial load or portion thereof on shaft 350 at second end 325 of shaft support 320, allowing rotation of shaft 350 and spool 360. Those skilled in the art, however, will recognize that axial spring 420 can be omitted, but with a possible degradation of rotation of spool 360.

A flexible member in the form of a strap or user link 130 (shown in FIG. 2) can be used with device 300. User link 130 has first end 132 connected to pin 158, shown in FIG. 3, that fits into opening 363 in spool 360. With shaft 350 extending through spool 360, the combination of pin 158 with user link 130 is too large to fit through opening 363 such that shaft 350 retains first end 132 of user link 130 within spool shaft 362. A remainder of user link 130 wraps around spool 360 and can be unwrapped and extended for use.

Referring to FIG. 24 and FIGS. 59-62, latch mechanism 440 has a generally elongate flat body 442 or other suitable geometry having a latching portion that includes a first end 444 and a second end 446. First end 444 is sized to fit into hourglass-shaped notch 338 and second end 446 is sized to fit into hourglass-shaped notch 336 such that latch mechanism 440 is pivotally engages first wall 322 and second wall 325 within notches 336, 338. Notch 338 includes an opening 339 that allows for insertion of latch 440 into notch 338. Each end 444, 446 includes a tab 450, 452, respectively, that releasably engages one of cam faces 372 on spool 360 to restrict rotation of spool 360 within handle 306. Tabs 450, 452 act to limit translational motion of latch 440 by engagement shaft support faces 322, 325. Tabs 450, 452 may also be tapered to reduce friction during motion of latch 450.

Figure 20:
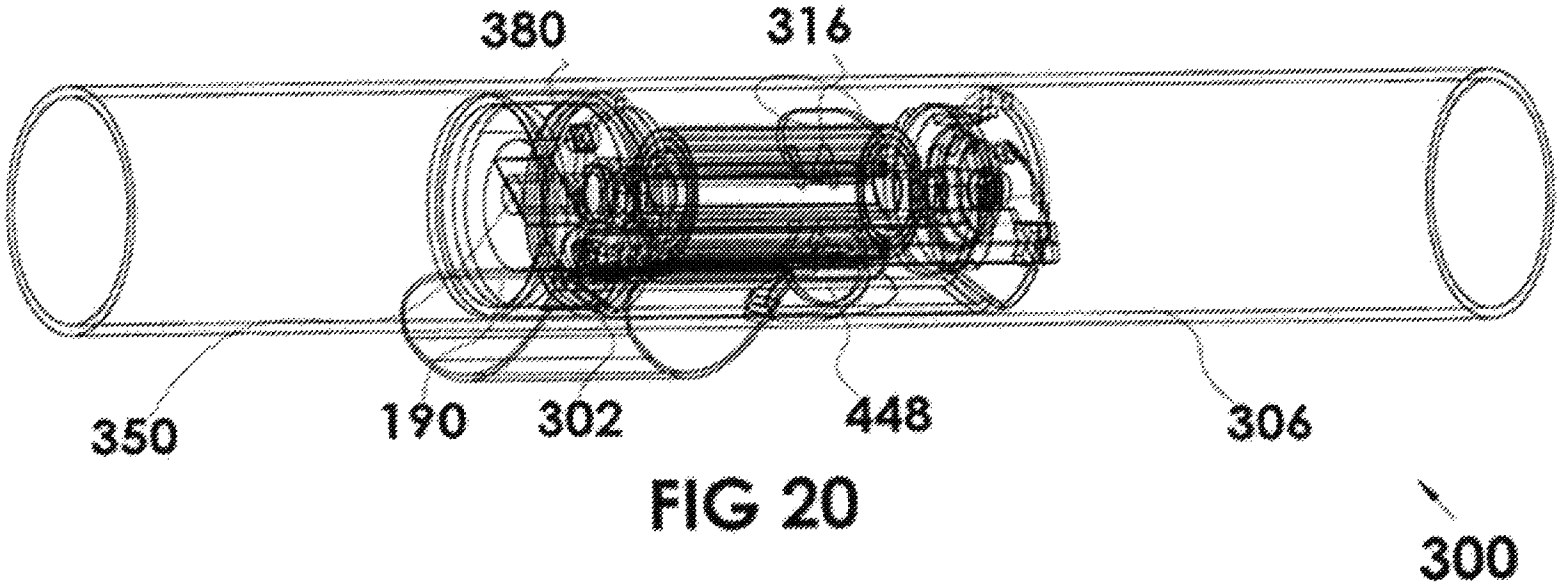
FIG. 20 is a left perspective view of an exercise device according to an alternative embodiment of the present invention, with interior components being visible through a handle.
Figure 21:
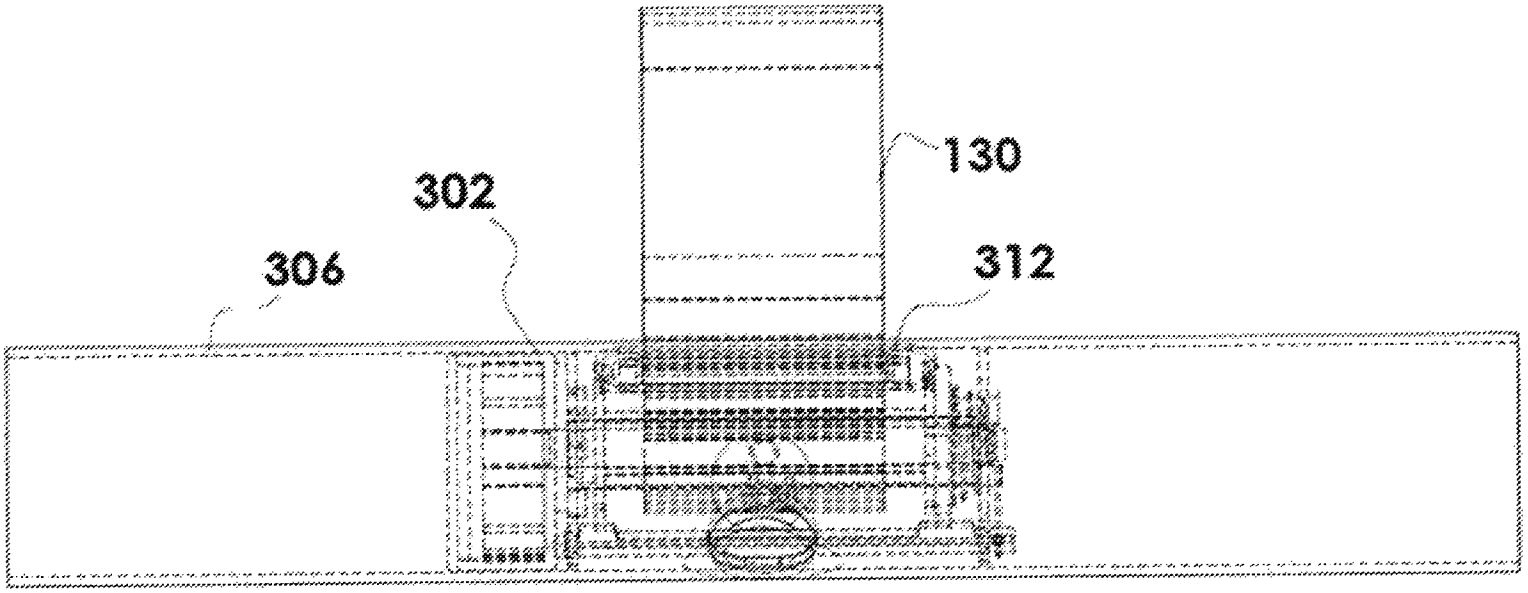
FIG. 21 is a top plan view of the device shown in FIG. 20.
Figure 22:
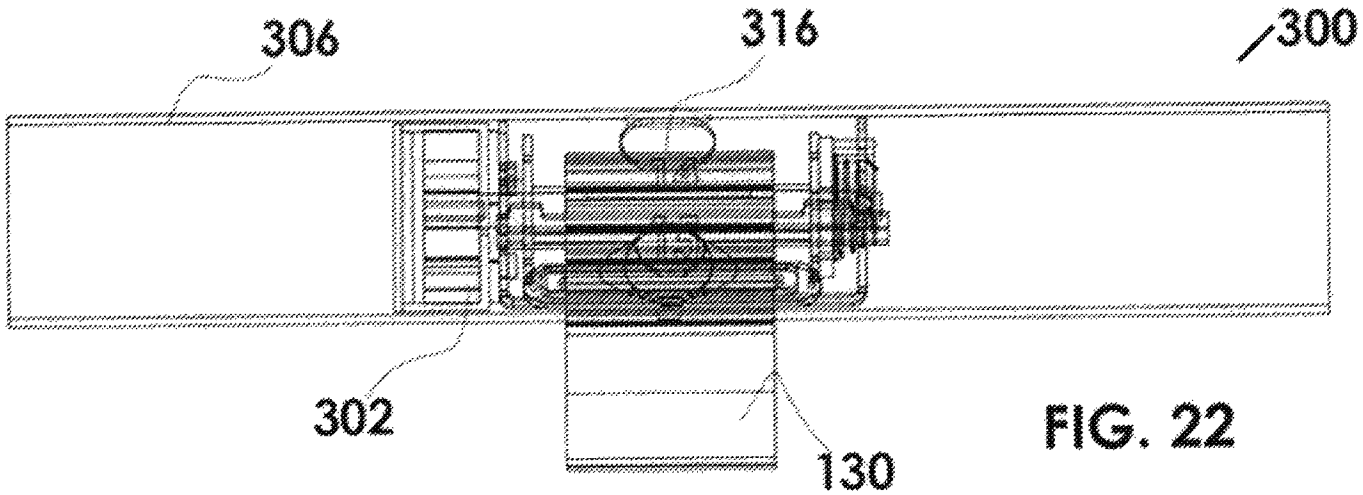
FIG. 22 is a front elevational view of the device shown in FIG. 20.
Figure 23:
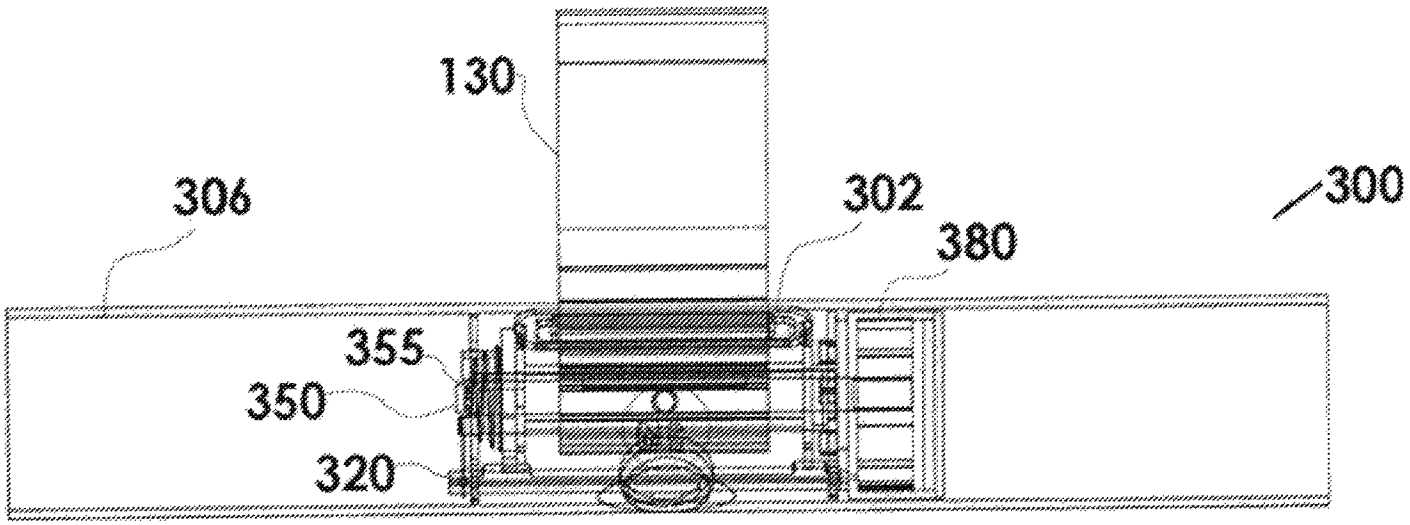
FIG. 23 is a bottom plan view of the device shown in FIG. 20.

Latch mechanism 440 has an activating portion 448 that extends outwardly of spool 360 toward latch through-opening 314 in tube 306. In an exemplary embodiment, activating portion 448 extends outwardly of handle 306, as shown in FIG. 20, although those skilled in the art will recognize that activating portion 448 can be located wholly within handle 306, requiring a user to insert a finger or other latch activating device, into latch through-opening 314 to activate latch mechanism 440. If latching member 448 extends outwardly of handle 306, a cover (not shown) can extend over latch through-opening 314 and latching member 408 to protect latching member 408 and prevent debris from entering into handle 306 through latch through-opening 314. The cover can be constructed from a pliable material such as, for example, a rubber, that allows the user to manipulate to operate latching member 408.

Latch mechanism 440 is movable between a first position wherein spool 360 is rotatable with respect to handle (not engaging cam faces 372) and a second position wherein spool 360 is fixed with respect to handle 306 (engaging cam faces 372).

Second end 446 includes a through opening 454 that is adapted to receive a first end 462 of a latch biasing member 460, shown in FIGS. 63-66. A second end 464 is connected to one of first wall 322 and second wall 325 of shaft support 320. In an exemplary embodiment, second end 464 is connected to tang 330 in first wall 322. Latch biasing member 460 biases latch 450 toward the position in which tabs 450, 452 engage cam faces 372.

To use device 300, a user inserts a foot (not shown) into loop 136 of user link 130 and grips handle 306, preferably with both hands. User biases latch mechanism 440 so that tabs 450, 452 are biased away from cam faces 372 and extends the foot, allowing spool 360 to rotate on shaft 350, extending user link 130 out of handle 306 through flexible member through-opening 312. As user link 130 is extended, biasing member 190 is wound, storing energy in biasing member 190. Additionally, the user can view indicia 138 on user link through indicia viewing through-opening 316 to see how far user link 130 has been extended.

At this point, the user can release latch mechanism 440, which is biased toward cam faces 372 by latch biasing member 460, restricting further rotation of spool 360. Spool 360 is then latched, preventing rotation and further unwinding of user link 130 from handle 306. The user can now perform his/her stretching exercise and view the indicia 138 on user link 130 to assess her/his hamstring flexibility. Those skilled in the art will recognize that device 300 can be used for stretching exercise and flexibility assessment (via indicia 138 on user link 130) of other human extremities. When the user is finished exercising, user can remove his/her foot from loop 136 and bias latch mechanism 440 away from cam faces 372. The energy stored in biasing member 190 is released, rotating spool 360 to retract user link 130 into handle and around spool 360.

Optionally, device 100, 300 could also be used for hip alignment/stretching exercise which may be the use of either device 100, 300, a reducing/increasing/telescopic device, and may or may not include pads or other receptors attached to the ends of either device 100, 300. This could also include means of tracking use, flex ratings, and also transmitting data to computers either wired or wireless.

Also, while the extension/retraction device is located in each of handles 110, 306, those skilled in the art will recognize that in an alternative embodiment, not shown, the extension/retraction device can be mounted around an outer perimeter of either of handle 110, 306.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. An exercise apparatus comprising:

a handle having a flexible member opening and a latch opening;

a shaft support attached to the handle, the shaft support having a first surface and a second surface, distal from the first surface;

a rotor mounted between the first surface and the second surface;

a flexible member having a first end connected to the rotor and a second end extending from the handle through the flexible member opening; and at least one latch mechanism having an activating portion accessible via the latch opening, the latch mechanism being movable between a first position wherein the rotor is rotatable with respect to the handle and a second position wherein the rotor is not rotatable with respect to the handle.

2. The exercise apparatus according to claim 1, wherein the flexible member has indicia thereon and wherein the handle has a viewing opening adapted to allow viewing of the indicia through the viewing opening.

3. The exercise apparatus according to claim 2 wherein the viewing opening is located to align within a viewing range of a user while the user is operating the exercise apparatus.

4. The exercise apparatus according to claim 1, further comprising at least one latch biasing member operatively connected to the latch mechanism, wherein the latch biasing member biases the latch mechanism toward the second position.

5. The exercise apparatus according to claim 1, where the rotor comprises a spool in combination with a shaft, the shaft having a first end engaging the first surface and a second end engaging the second surface, wherein the spool is rotatable with respect to the handle.

6. The exercise apparatus according to claim 5, further comprising a rotor biasing member disposed over one of the first end and the second end, the rotor biasing member having a first biasing member end engaged with the shaft.

7. The exercise apparatus according to claim 6, further comprising a rotor biasing member retainer, the retainer having means for retaining the biasing member.

8. The exercise apparatus according to claim 7, wherein the retainer is connected to one of the first surface and the second surface.

9. The exercise apparatus according to claim 5, wherein the spool biasing member is a spiral spring.

10. The exercise apparatus according to claim 9, wherein the spiral spring is wound between about 10 and about 35 turns.

11. The exercise apparatus according to claim 1, wherein the rotor comprises a spool having a shaft, the shaft having a first spool shaft end and a second spool shaft end, the first surface engaging the first shaft end, and the second surface engaging the second shaft end, wherein at least one of the first surface and the second surface comprises a latch engagement face.

12. The exercise apparatus according to claim 11, wherein, when the latch mechanism is in the second position, the latch mechanism engages the latch engagement face.

13. The exercise apparatus according to claim 1, wherein the rotor comprises a spool having a shaft, the shaft having a first spool shaft end and a second spool shaft end, the first surface engaging the first shaft end, and the second surfaces engaging the second shaft end, wherein the latch mechanism is mounted independently of the shaft support.

14. The exercise apparatus according to claim 1, wherein the rotor comprises a spool having a shaft, the shaft having a first spool shaft end and a second spool shaft end, the first surface engaging the first shaft end, and the second surface engaging the second shaft end, wherein the latch mechanism is located off center of the handle.

15. The exercise apparatus according to claim 1, wherein the latch mechanism is located inside the handle and has an actuator extending through the latch opening.

16. The exercise apparatus according to claim 1, wherein the handle is comprised of more than one component.

17. The exercise apparatus according to claim 1, further comprising a rewind latch release mechanism adapted to move the latch mechanism away from the rotor.

18. The exercise apparatus according to claim 17, further comprising a biasing member adapted to bias the rewind release mechanism.

19. The exercise apparatus according to claim 18, wherein the biasing member biases the rewind latch release mechanism toward the rotor.

20. The exercise apparatus according to claim 19, wherein the rewind latch release mechanism has at least one protrusion used to interact with any non-rotor portion of the exercise apparatus.

21. The exercise apparatus according to claim 1, wherein the flexible member is a flexible strap inextensible in a tensile direction.

22. An exercise apparatus comprising:

a handle having at least one hollow portion;

at least one shaft support fixedly mounted in the handle;

a spool rotatably mounted on at least one shaft support;

a flexible strap having a first end secured to the spool and a second end extending outwardly from the spool; and a latching mechanism having a first position wherein the spool is rotatable with respect to the handle and a second position wherein the spool is fixed with respect to the handle.

23. The exercise apparatus of claim 22, wherein the second end of the flexible strap comprises means for engaging a user's foot.

24. The exercise apparatus according to claim 22, further comprising a biasing member connected to the latching mechanism, the biasing member adapted to bias the latching mechanism to the second position.

25. The exercise mechanism according to claim 22, further comprising a biasing member adapted to rewind the flexible member onto the spool.

26. The exercise apparatus according to claim 22, further comprising a shaft supporting the spool and having a shaft end engaging the shaft support, wherein the biasing member engages the shaft.

27. The exercise apparatus according to claim 26, wherein the spool has an axially-centered spool through-opening and wherein the shaft support has at least one of an axially centered support through-opening and an off-centered support through-opening, and wherein the shaft extends through the spool through-opening and the support through-opening.

28. An exercise apparatus comprising:

a handle having a strap opening, a latch opening, and a viewing opening formed therein;

at least one shaft support fixedly mounted to the handle;

a shaft supported by the shaft support;

a rotor mounted on the shaft, at least one of the rotor and the shaft having at least one cam face extending around a periphery thereof;

a strap having a first end attached to the rotor and a second end extending outwardly from the handle through the strap opening, the first end having means for engaging a user's extremity, the strap further having indicia viewable in the viewing opening;

a release washer mechanism mounted on the shaft and having at least one release washer cam face extending around a periphery thereof;

a latching mechanism having a first portion extending outwardly towards the latch opening, the latching mechanism having at least one portion adapted to engage at least one portion of the rotor, wherein the at least one portion of the latching mechanism is adapted to disengage from the at least one portion of the rotor upon the impartation of force upon the latching mechanism by at least one of the rewind release washer mechanism and the user;

a first biasing member attached to the latching mechanism and adapted to bias the at least one portion of the latching mechanism against at least one portion of the rotor; and a second biasing member having a first end attached to the shaft and a second fixed end, the second biasing member adapted to manipulate the strap around the rotor when the latching mechanism is disengaged from the at least one of portion of the rotor, wherein the second biasing member comprises a retainer.

* * * * *